US010781560B2

(12) United States Patent
Hamilton et al.

(10) Patent No.: US 10,781,560 B2
(45) Date of Patent: Sep. 22, 2020

(54) RAILWAY FASTENER REMOVAL SYSTEM

(71) Applicant: MOW Equipment Solutions, Inc., Linwood, KS (US)

(72) Inventors: William Michael Hamilton, Linwood, KS (US); Ryan Jay Koci, Stilwell, KS (US); Justin Wynne Tomac, Bonner Springs, KS (US)

(73) Assignee: MOW EQUIPMENT SOLUTIONS, Linwood, KS (US)

( * ) Notice: Subject to any disclaimer, the term of this patent is extended or adjusted under 35 U.S.C. 154(b) by 343 days.

(21) Appl. No.: 15/886,957

(22) Filed: Feb. 2, 2018

(65) Prior Publication Data

US 2018/0223483 A1 Aug. 9, 2018

Related U.S. Application Data

(60) Provisional application No. 62/454,446, filed on Feb. 3, 2017.

(51) Int. Cl.
*E01B 29/28* (2006.01)
*B25B 21/00* (2006.01)
*E01B 25/30* (2006.01)

(52) U.S. Cl.
CPC ..... *E01B 29/28* (2013.01); *B25B 21/001* (2013.01); *B25B 21/002* (2013.01); *E01B 25/305* (2013.01)

(58) Field of Classification Search
CPC ..... E01B 29/28; E01B 25/305; B25B 21/001; B25B 21/002
USPC ..... 104/17.2
See application file for complete search history.

(56) References Cited

U.S. PATENT DOCUMENTS 4,457,060 A 7/1984 Parks et al.
4,890,558 A * 1/1990 Quella ..... E01B 29/26 104/17.2
4,903,611 A * 2/1990 Holley ..... E01B 29/32 104/17.2
5,074,219 A * 12/1991 Theurer ..... E01B 29/32 104/17.2

(Continued)

OTHER PUBLICATIONS

Notice of Publication dated Oct. 6, 2016 in U.S. Appl. No. 15/090,428, all pages.

(Continued)

*Primary Examiner* — Jason C Smith
(74) *Attorney, Agent, or Firm* — Kilpatrick Townsend & Stockton LLP

(57) ABSTRACT

Systems, methods, and non-transitory, machine-readable media for railway fastener removal are disclosed. A railway fastener extractor may be aligned with a railway fastener installed in a railway tie. The railway fastener extractor may be coupled with a frame assembly and a cylinder and slide assembly of a railway workhead so that the railway fastener extractor is suspended from the cylinder and slide assembly. The railway fastener extractor may be operated to extend opposing claws of the railway fastener extractor toward a railway fastener, and may be operated to selectively apply force to a linkage system to grip the railway fastener, the force being directed along a longitudinal axis. The force may be bifurcated and corresponding forces may be applied to move linkages and move the opposing claws to grip the railway fastener, and the railway fastener extractor may be operated to extract the railway fastener.

20 Claims, 20 Drawing Sheets

(56) References Cited

U.S. PATENT DOCUMENTS

| | | | | | |
|---|---|---|---|---|---|
| 5,117,760 | A * | 6/1992 | Almaraz | E01B 29/32 | 104/17.2 |
| 5,277,122 | A * | 1/1994 | Almaraz | E01B 29/32 | 104/17.2 |
| 5,331,899 | A * | 7/1994 | Holley | E01B 29/32 | 104/16 |
| 5,438,931 | A * | 8/1995 | Becker | E01B 29/32 | 104/17.2 |
| 5,577,447 | A * | 11/1996 | Weber | E01B 29/28 | 104/17.1 |
| 5,586,502 | A * | 12/1996 | Weber | E01B 29/24 | 104/17.2 |
| 5,694,856 | A * | 12/1997 | Theurer | E01B 29/32 | 104/17.2 |
| 5,730,060 | A * | 3/1998 | Straub | E01B 29/32 | 104/17.2 |
| 5,915,744 | A * | 6/1999 | Cotsford | E01B 29/32 | 104/17.2 |
| 6,138,573 | A | 10/2000 | Brenny et al. | | |
| 6,662,729 | B1 * | 12/2003 | Madison | E01B 29/32 | 104/17.2 |
| 7,104,200 | B2 * | 9/2006 | Hosking | E01B 29/24 | 104/17.2 |
| 7,574,961 | B2 * | 8/2009 | Barezzani | E01B 29/24 | 104/17.2 |
| 7,677,177 | B2 * | 3/2010 | Ganz | E01B 29/32 | 104/17.1 |
| 8,485,103 | B2 * | 7/2013 | Miller | E01B 29/26 | 104/17.2 |
| 8,522,688 | B2 | 9/2013 | Pritzl | | |
| 2011/0072998 | A1 * | 3/2011 | Noll | E01B 29/32 | 104/16 |
| 2011/0308421 | A1 * | 12/2011 | Pritzl | E01B 29/32 | 104/17.2 |
| 2013/0276278 | A1 * | 10/2013 | Barezzani | E01B 29/32 | 29/243.56 |
| 2015/0053449 | A1 * | 2/2015 | Henke | E01B 29/26 | 173/128 |
| 2016/0153151 | A1 * | 6/2016 | Irion | E01B 29/10 | 104/9 |
| 2016/0289899 | A1 * | 10/2016 | Hamilton | E01B 29/32 | |
| 2018/0223483 | A1 * | 8/2018 | Hamilton | B25B 21/001 | |

OTHER PUBLICATIONS

Non Final Office Action dated Sep. 2, 2018 in U.S. Appl. No. 15/090,428, all pages.

Notice of Allowance dated Sep. 14, 2018 in related U.S. Appl. No. 15/090,428, all pages.

* cited by examiner

RAILWAY FASTENER REMOVAL SYSTEM

CROSS-REFERENCE TO RELATED APPLICATION

The present non-provisional application claims benefit of and priority to U.S. Provisional Application No. 62/454,446, filed on Feb. 3, 2017, by Hamilton et al. and entitled "Railway Fastener Removal System," the entire disclosure of which is incorporated herein by reference for all purposes.

BACKGROUND

Certain embodiments of the present disclosure relate generally to railways, and in particular to maintenance of way with apparatuses and methods for railway fastener removal.

With the hundreds of thousands of miles of railroad track traversing the United States alone, in addition to the great lengths throughout other countries of the world, maintenance of way is a tremendous and important effort. Rails of railroad tracks are often fastened to railway ties with a combination of railway spikes, tie plates fastened to the railway ties with the railway spikes, and railway anchors attached to undersides of the rails to anchor the rails to sides of the railway ties. Oftentimes, lag screws are used instead of railway spikes. The lag screws are driven into railway ties, which are typically made of wood or other similar materials.

Maintenance of way processes often require removal of the lag screws in order to perform various maintenance tasks such as replacement of railway ties, other railway components, and the like. Under current work practices, typical lag screw removal is done by hand with hand tools. Current work practices involve using a machine to attempt "unscrewing" the lag screws (turning them in the counter-clockwise direction so they back out or "advance" out of the wood tie. There are two scenarios which may exist and make it impossible for the "unscrewing" machine to remove the lag screw: first, the wood of the tie is so badly deteriorated through long term exposure to weather/environmental conditions the lag screw threads cannot sufficiently engage their mating threads in the wood tie and therefore cannot cause the screw to advance when it is turned (in either direction); second, during the initial installation of the screw the hydraulic powered machine used to install the screws over-torqued the screw and caused the threads to strip which breaks the mating wooden threads inside the tie such that they cannot provide resistance against the lag screw threads. In the event the lag screw is stripped inside the tie or the tie is deteriorated such that the wooden mating threads are broken or inadequate to provide necessary resistance to cause the screw to advance normally when it is turned, the machine operators must park their machines and attempt to remove the stripped lag screws manually with hand tools. Using the hand tools involves walking along the track outside of the protected environment of a machine's operator station and physically prying/pulling the stripped lag screws by hand. Potential dangers to the operator performing the task manually involve personal injury due to physical strain and walking along the uneven track bed as well as the potential to be struck by another piece of work equipment because the operator of that machine may not see the worker walking along the track. Lastly, because a significant portion of the lag screw removal process must be done manually, this causes the typical work gang to work in a more spread-out fashion—their work footprint is much longer (up to one mile or further). In other words, the unscrewing machines must work much further ahead of the rest of the gang to allow for the necessary time to manually remove some screws. This increased work footprint may cause "slow orders" to be in effect for regular rail traffic that may need to run over the section of track being worked on by the gang because they could not re-affix the entire length of track under maintenance before quitting work for the day. The work window may be 8-12 hours long and may include removing numbers of lag screws on the order of thousands or tens of thousands per day. Several issues are presented by the conventional approach, including issues redounding in inefficiencies, costs, and risks for personal injury. The trend is toward shorter and shorter work windows, with a desire for more productivity. Moreover, workers must traverse significant distances of uneven surfaces of a railway. These activities present risks for back injuries, knee injuries, ankle injuries, among others that occur with current work practices.

Significant time is devoted to the manual lag screw removal, especially considering problems frequently encountered. The lag screw driving process is prone to immediately stripping the threaded engagement of a given lag screw with a given railway tie. An over-torqued and, consequently, stripped lag screw, is many times not detectable at the time of installation. In any case, removal of a lag screw from a stripped engagement is difficult, due to the insufficient or non-existent threaded engagement to support unscrewing the lag screw from the railway tie.

Sometimes, even when a lag screw is installed without stripping, other difficulties with lag screw removal exist. The wood or other materials comprising railway ties age and deteriorate over time due to railway use and environmental conditions. It is not uncommon that the railway tie material deteriorates to a point where it cannot support reverse drill-out, such that the lag bolt will not back out with reverse screwing.

These problems not only detract from productivity, but also increase risk of personal injury. Thus, there is a need to solve these problems and provide for apparatuses and methods for railway fastening component removal. These and other needs are addressed by the present disclosure.

BRIEF SUMMARY

Certain embodiments of the present disclosure relate generally to railway, and in particular to maintenance of way with apparatuses and methods for railway fastener removal.

In one aspect, a railway fastener removal system is disclosed. The railway fastener removal system may include one or a combination of the following. A railway fastener extractor may be couplable with a frame assembly and a cylinder and slide assembly of a railway workhead so that the railway fastener extractor is suspended from the cylinder and slide assembly. The railway fastener extractor may include a first actuator and a second actuator coaxially coupled to the first actuator so that the first actuator and the second actuator share a longitudinal axis. The railway fastener extractor may include a pair of opposing claws, each opposing claw of the pair of opposing claws including a gripping surface. The railway fastener extractor may include a linkage system coupling the pair of opposing claws with the second actuator, the linkage system including linkages arranged about the longitudinal axis. The first actuator may be operable to extend the pair of opposing claws toward a railway fastener when the railway fastener is in an installed position with respect to a railway tie plate and a railway tie alongside a rail so that the railway fastener extends through the railway tie plate and into the railway tie. The second actuator may be operable to selectively apply a force to the linkage system, the force directed along the longitudinal axis. The linkage system may be adapted to bifurcate the force and apply corresponding forces to move the linkages and move the pair of opposing claws so that the gripping surfaces close toward each other or open away from each other. The railway fastener extractor may be operable to selectively grip the railway fastener with the gripping surfaces of the pair of opposing claws when the railway fastener is in the installed position by one operation of the second actuator. The railway fastener extractor may be operable to extract the railway fastener from the railway tie plate and the railway tie by operation of the first actuator. The railway fastener extractor may be operable to release the railway fastener after the railway fastener is extracted by a subsequent operation of the second actuator.

In another aspect, a method of railway fastener removal is disclosed. The method may include one or a combination of the following. Aligning of a railway fastener extractor with a railway fastener may be caused when the railway fastener is in an installed position with respect to a railway tie plate and a railway tie alongside a rail so that the railway fastener extends through the railway tie plate and into the railway tie. The railway fastener extractor may be coupled with a frame assembly and a cylinder and slide assembly of a railway workhead so that the railway fastener extractor is suspended from the cylinder and slide assembly. A first actuator of the railway fastener extractor may be operated to extend a pair of opposing claws of the railway fastener extractor toward a railway fastener when the railway fastener is in the installed position, where each opposing claw of the pair of opposing claws includes a gripping surface. A second actuator of the railway fastener extractor may be operated to selectively apply a force to a linkage system of the railway fastener extractor and to grip the railway fastener with the gripping surfaces of the pair of opposing claws when the railway fastener is in the installed position, the force being directed along a longitudinal axis. The second actuator may be coaxially coupled to the first actuator so that the first actuator and the second actuator share the longitudinal axis. The linkage system may couple the pair of opposing claws with the second actuator, the linkage system including linkages arranged about the longitudinal axis. The linkage system may be adapted to bifurcate the force and apply corresponding forces to move the linkages and move the pair of opposing claws so that the gripping surfaces close toward each other or open away from each other. The first actuator may be operated to extract the railway fastener from the railway tie plate and the railway tie. The second actuator may be operated to release the railway fastener after the railway fastener is extracted.

In yet another aspect, one or more non-transitory, machine-readable media are disclosed. The one or more non-transitory, machine-readable media may have machine-readable instructions thereon which, when executed by one or more processing devices, causes the one or more processing devices to instruct a railway workhead to perform one or a combination of the following. Aligning of a railway fastener extractor with a railway fastener may be caused when the railway fastener is in an installed position with respect to a railway tie plate and a railway tie alongside a rail so that the railway fastener extends through the railway tie plate and into the railway tie. The railway fastener extractor may be coupled with a frame assembly and a cylinder and slide assembly of the railway workhead so that the railway fastener extractor is suspended from the cylinder and slide assembly. Operation of a first actuator of the railway fastener extractor may be caused to extend a pair of opposing claws of the railway fastener extractor toward a railway fastener when the railway fastener is in the installed position, where each opposing claw of the pair of opposing claws includes a gripping surface. Operation of a second actuator of the railway fastener extractor may be caused to selectively apply a force to a linkage system of the railway fastener extractor and to grip the railway fastener with the gripping surfaces of the pair of opposing claws when the railway fastener is in the installed position, the force being directed along a longitudinal axis. The second actuator may be coupled coaxially to the first actuator so that the first actuator and the second actuator share the longitudinal axis. The linkage system may couple the pair of opposing claws with the second actuator, the linkage system including linkages arranged about the longitudinal axis. The linkage system may be adapted to bifurcate the force and apply corresponding forces to move the linkages and move the pair of opposing claws so that the gripping surfaces close toward each other or open away from each other. Operation of the first actuator may be caused to extract the railway fastener from the railway tie plate and the railway tie. Operation of the second actuator may be caused to release the railway fastener after the railway fastener is extracted.

In various embodiments, the railway fastener removal system may include the frame assembly and the cylinder and slide assembly of the railway workhead coupled to the railway fastener extractor. The cylinder and slide assembly may include one or more additional actuators adapted to cause movement of the railway fastener extractor with respect to the frame assembly along multiple planes. In various embodiments, the railway fastener removal system may further include a pair of railway fastener extractors in an opposing arrangement to selectively engage a first plurality of railway fasteners installed on a gage side of the rail and a second plurality of railway fasteners installed on a field side of the rail, where the railway fastener extractor is one of the pair of railway fastener extractors. In various embodiments, each railway fastener extractor of the pair of railway fastener extractors may be configured to operate independently of the other of the pair of railway fastener extractors.

Various embodiments may further include operating a pair of railway fastener extractors arranged in an opposing arrangement to selectively engage a first plurality of railway fasteners installed on a gage side of the rail and a second plurality of railway fasteners installed on a field side of the rail, where the railway fastener extractor is one of the pair of railway fastener extractors. In various embodiments, the operating the pair of railway fastener extractors may include operating each railway fastener extractor of the pair of railway fastener extractors independently of the other of the pair of railway fastener extractors. In various embodiments, the aligning of the railway fastener extractor may include operating one or more additional actuators of the cylinder and slide assembly to cause movement of the railway fastener extractor with respect to the frame assembly along multiple planes.

In various embodiments, at least one of the railway fasteners may correspond to a lag screw. In various embodiments, the lag screw may include a head, and the railway fastener extractor may be configured to grip the head of the lag screw. In various embodiments, the head of the lag screw may be disposed at least partially in a recess of the railway tie plate when the lag screw is in the installed position.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the following appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Various embodiments will now be discussed in greater detail with reference to the accompanying figures, beginning with FIG. 1A.

Figure 1A:
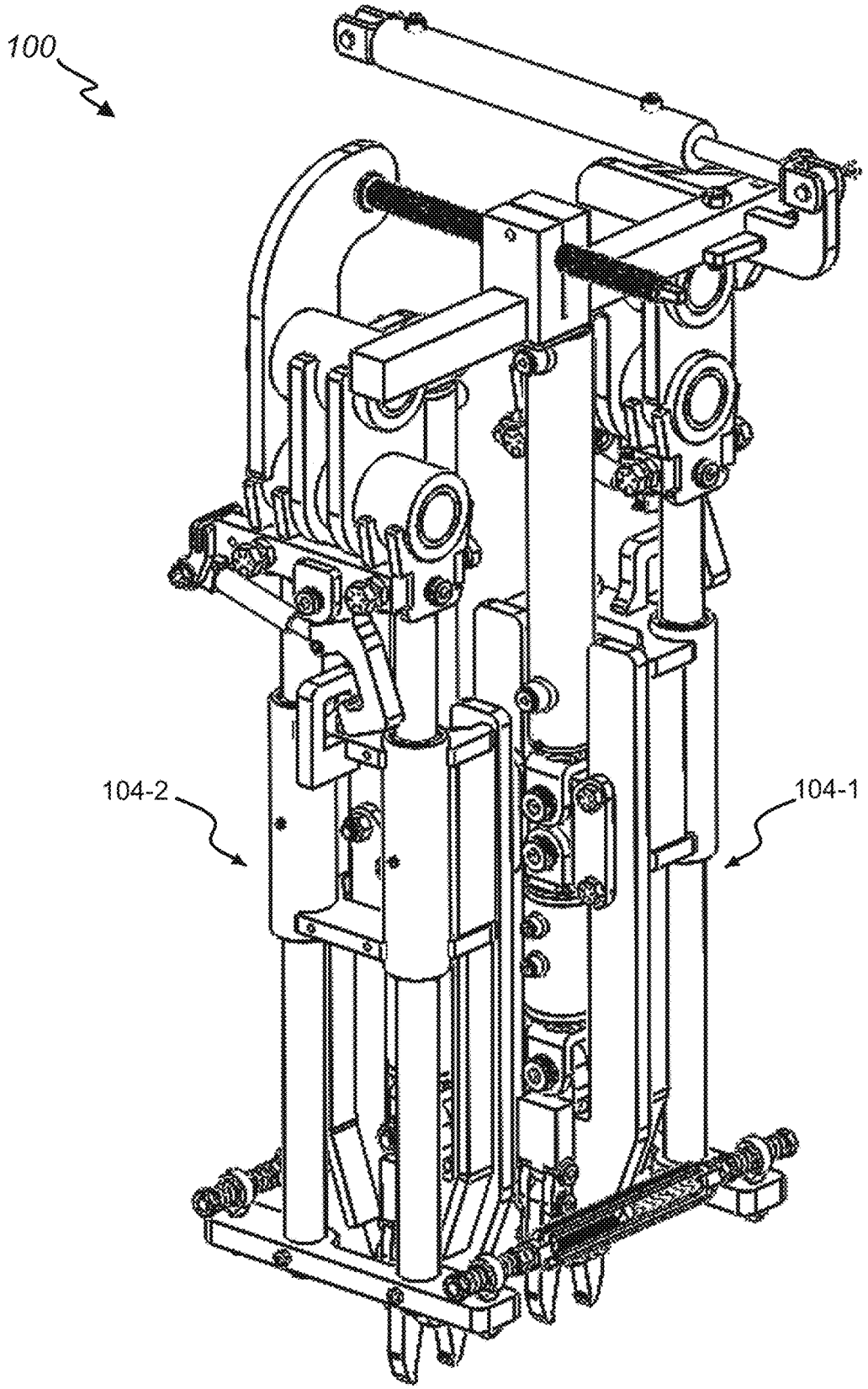
FIG. 1A depicts a perspective view of a railway fastener removal system, in accordance with certain embodiments of the present disclosure.
Figure 1B:
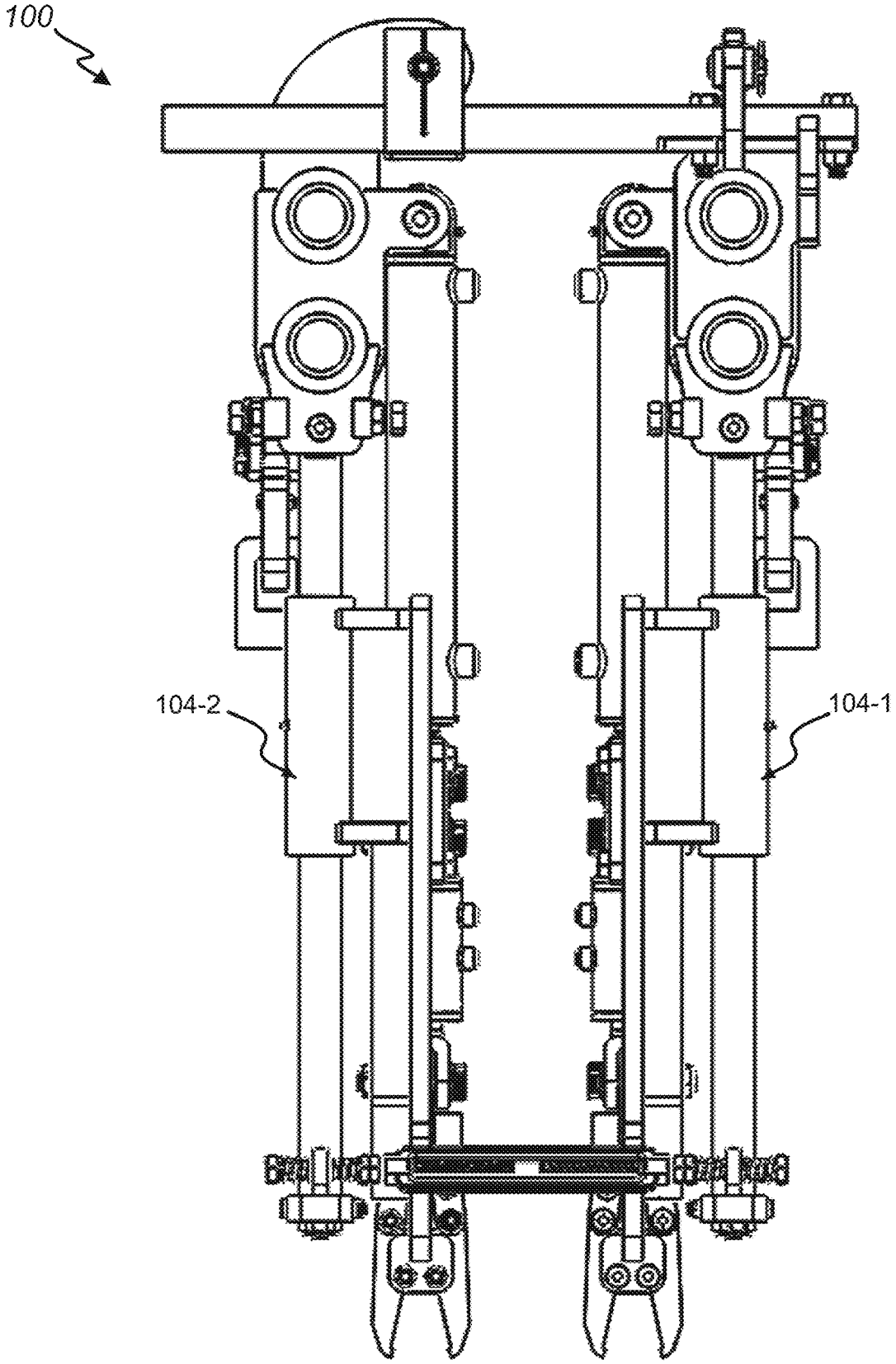
FIG. 1B depicts an end view of the railway fastener removal system, in accordance with certain embodiments of the present disclosure.
Figure 1C:
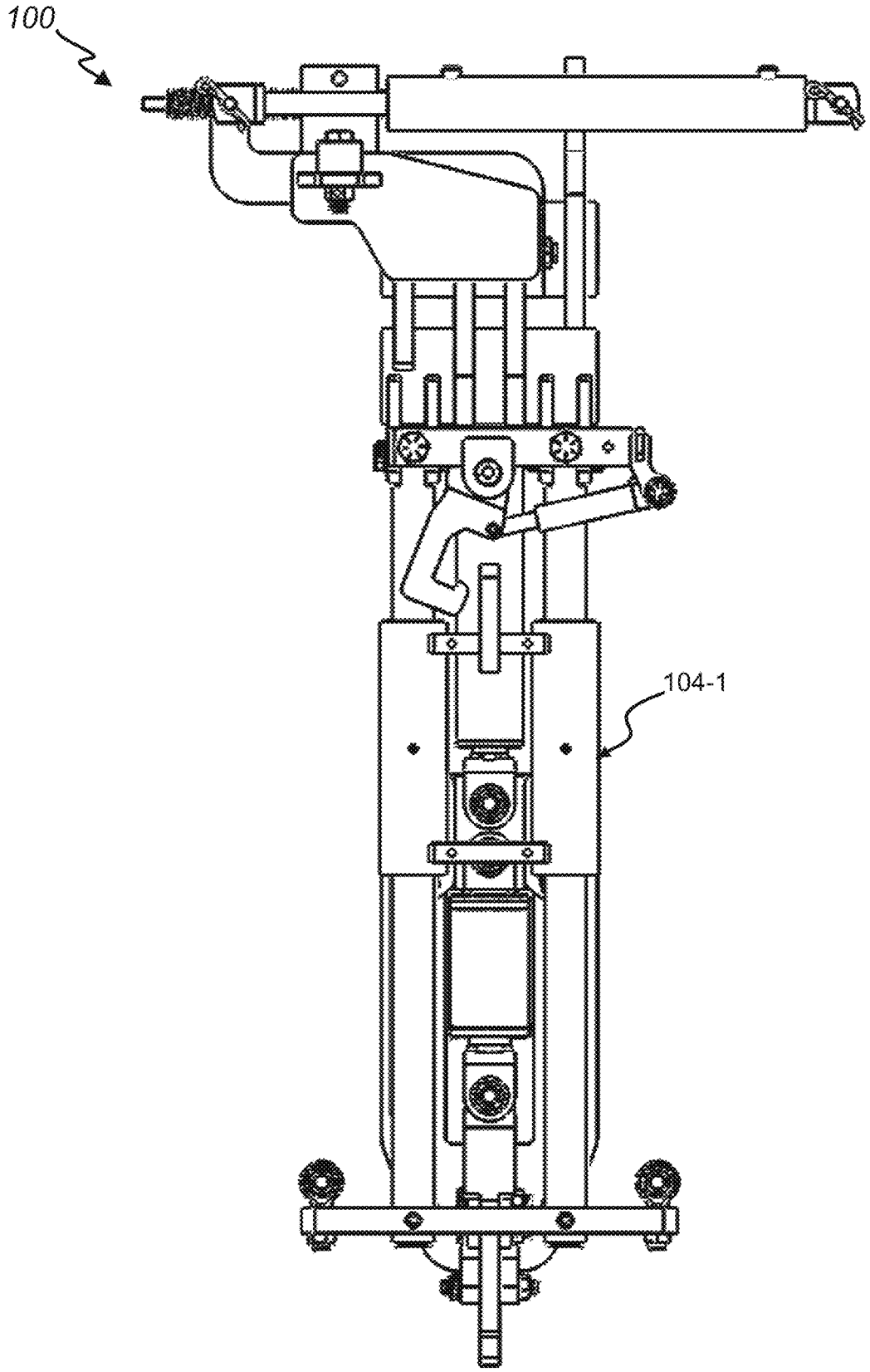
FIG. 1C depicts a side view of the railway fastener removal system, in accordance with certain embodiments of the present disclosure.

FIG. 1A depicts a perspective view of a railway fastener removal system 100, in accordance with certain embodiments of the present disclosure. FIG. 1B depicts an end view of the railway fastener removal system 100, in accordance with certain embodiments of the present disclosure. FIG. 1C depicts a side view of the railway fastener removal system 100, in accordance with certain embodiments of the present disclosure.

In various embodiments, the railway fastener removal system 100 may include one or more railway fastener extractors 104 (each of which may be alternatively referenced herein as a gripper-puller mechanism or a gripper-puller tool). Each railway fastener extractor 104 may correspond to a subsystem of the railway fastener removal system 100. As depicted, certain embodiments may include a pair of railway fastener extractors 104-1, 104-2. As disclosed herein, the range of movement of each railway fastener extractor 104 includes not only lateral and/or horizontal movement components, but also elevational and/or vertical movement components. Accordingly, the railway fastener extractors 104 may be disposed in a variety of different positions to facilitate fastener removal in accordance with certain embodiments disclosed further herein.

Figure 2A:
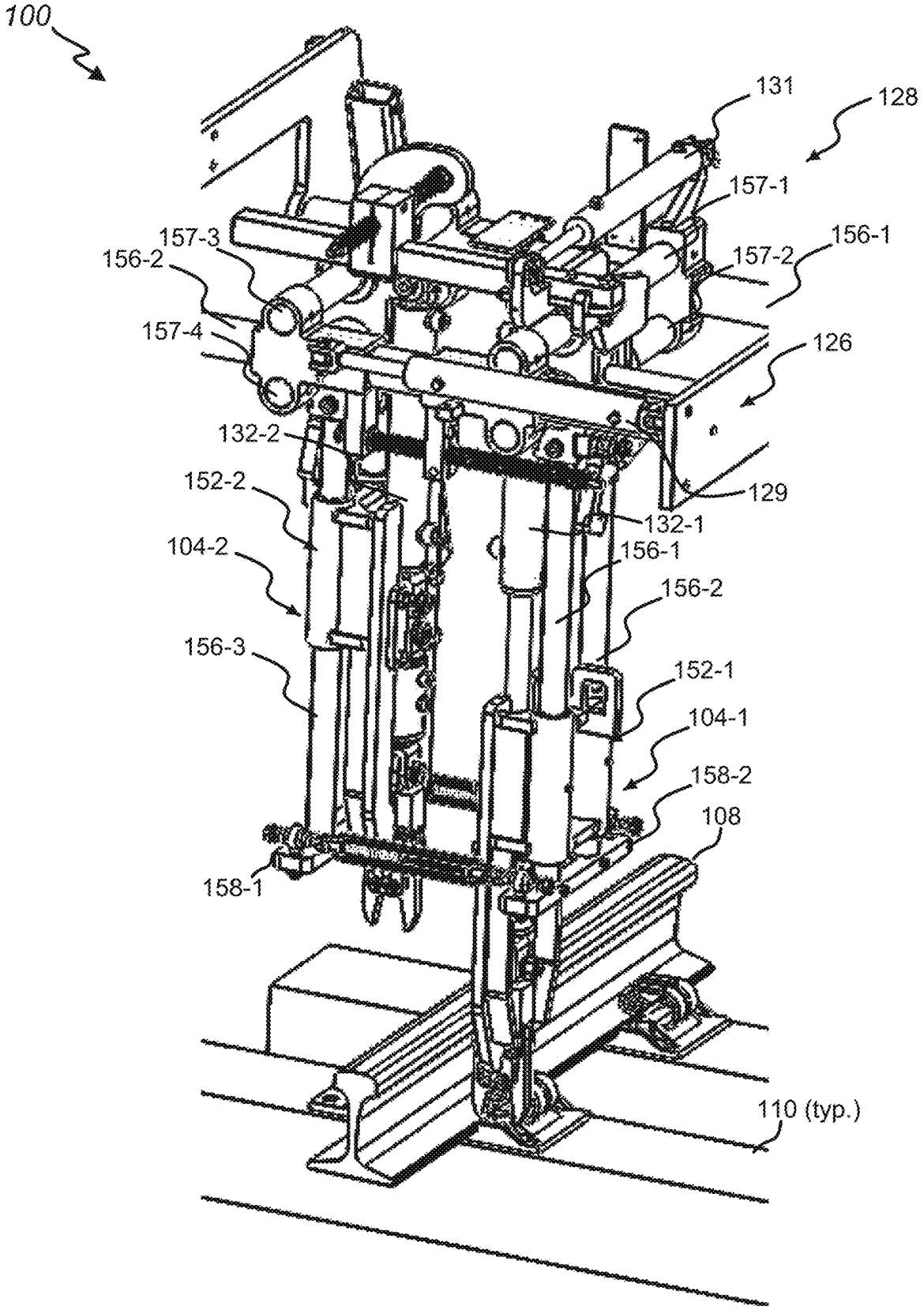
FIG. 2A depicts the perspective view of the railway fastener removal system in one example deployed state on a railway, in accordance with certain embodiments of the present disclosure.
Figure 2B:
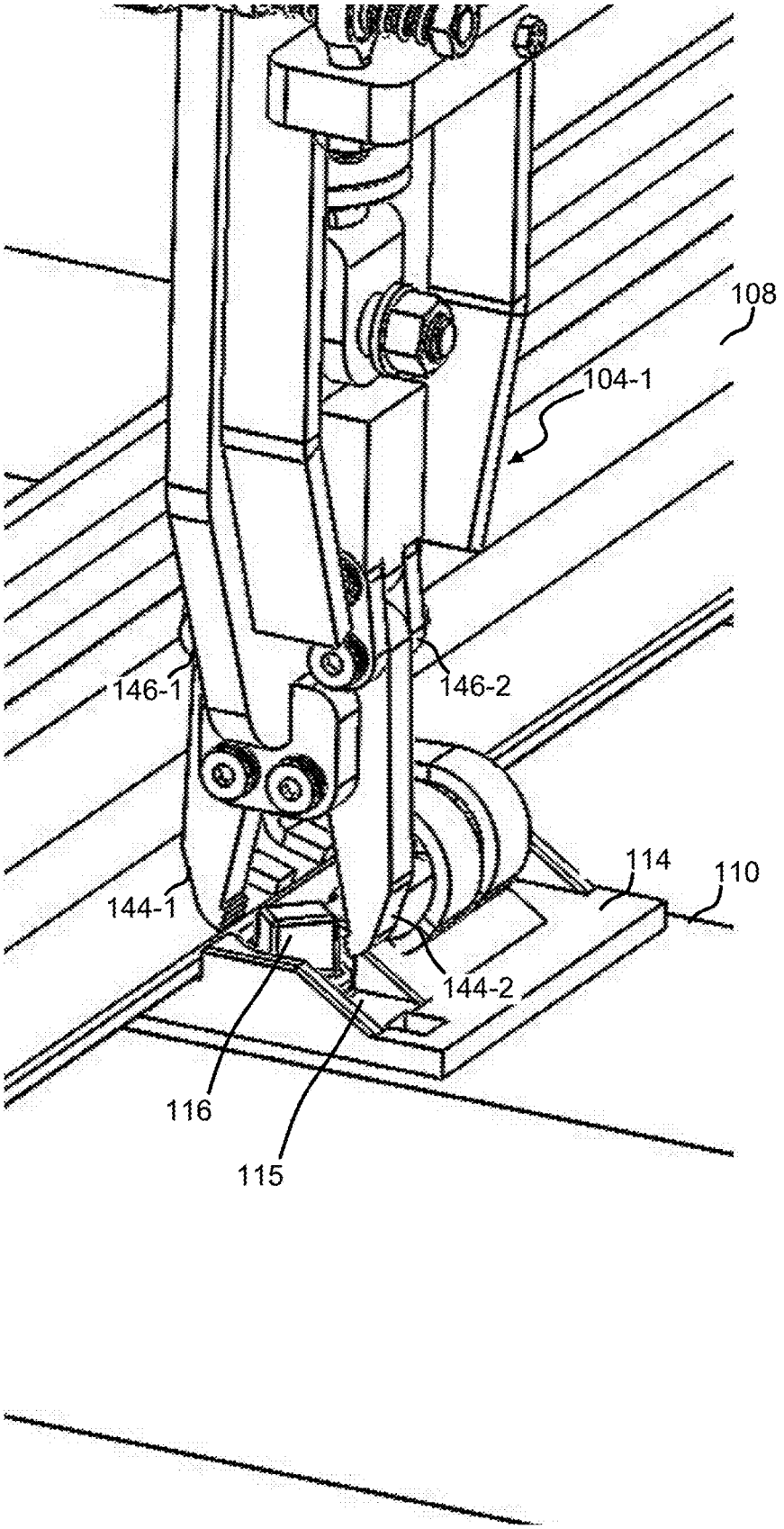
FIG. 2B depicts a partial close-up of the perspective view of the railway fastener removal system in one deployed state on the railway, in accordance with certain embodiments of the present disclosure.

FIG. 2A depicts the perspective view of the railway fastener removal system 100 in one example deployed state on a railway, in accordance with certain embodiments of the present disclosure. FIG. 2B depicts a partial close-up of the perspective view of the railway fastener removal system 100 in one deployed state on the railway, in accordance with certain embodiments of the present disclosure. The railway, as is typical, comprises a pair of rails 108 (though only one rail 108 is depicted in various views herein) supported by a plurality of railway ties 110 and fastened to the railway ties 110 with a combination of railway fasteners 116, tie plates 114 fastened to the railway ties 110 with the railway fasteners 116 driven through fastener holes of the tie plates 114. As used herein, the term "gage side" or "gauge side" is used to indicate an association with a space between the pair of rails 108 and/or a side of a rail 108 or other component exposed to, facing, and/or oriented toward the space between the pair of rails 108. The term "field side" is used to indicate an association with a space external to the pair of rails 108 and/or a side of a rail 108 or other component exposed to, facing, and/or oriented toward the space external to the pair of rails 108.

The railway fastener removal system 100 may remove multiple, different types of railway fasteners 116. In some instances, a railway fastener 116 may be a railway spike. In other instances, a railway fastener 116 may be a lag screw. The depicted examples herein show the railway fastener 116 as a lag screw. The lag screw 116 may have a head, such as the block head illustrated, that may be in any of a number of orientations when the railway fastener extractor 104 engages the lag screw 116.

Materials for various structural components of the fastener removal system 100 may be selected such that the structural components can generate necessary forces to move a railway components in accordance with various embodiments disclosed herein, while safely withstands stresses imparted to the structural elements of the system from those aforementioned forces. Said materials may include structural quality alloy steels with medium to high carbon content and may involve certain heat treatment and tempering to produce components with the necessary strength.

While certain embodiments of the fastener removal system 100 are illustrated as an example, the fastener removal system 100 may include other types of railway machinery and workheads not shown. Other embodiments, for example, may include spike-driving workheads, railway anchor installation workheads, and/or any other suitable type of railway installation and/or maintenance machinery. In various embodiments, the fastener removal system 100 may be adapted for conjunction with a variety of railway workheads.

The railway fastener removal system 100 may be coupled to a motorized railway maintenance vehicle (not shown). The railway maintenance vehicle may include an engine, a chassis, wheels for traversing along one or more of the rails 108, and other suitable components known to a person of ordinary skill in the art. Accordingly, the railway maintenance vehicle may include an operator cab, station, or other area with control elements of a control system that allow for control of the railway maintenance vehicle. The railway maintenance vehicle may be any suitable vehicle adapted for coupling to the fastener removal system 100.

Referring, for example, to FIG. 2A, the fastener removal system 100 may include a rigid, metal frame assembly 126. Frame configurations other than that depicted may be included in other embodiments. As illustrated in various figures, a pair of railway fastener extractors 104 may be configured in an opposing arrangement. In a deployed state, the railway fastener extractors 104 may be disposed on opposite sides of the rail 108. Each railway fastener extractor 104 may slidably connected with the rest of the workhead of the fastener removal system 100 via a dual slide and shaft coupling 152 to allow for slidable movement along shafts 156 of the frame assembly 126 with extension and retraction a lift actuator, such as a lift cylinder 132.

The lift cylinder 132 and/or other cylinders in various embodiments described herein may correspond to any one or combination of hydraulic actuators, pneumatic actuators, electric actuators, and/or the like to extend and retract in accordance with disclosed embodiments, and may be referenced herein as power cylinders or actuators. The actuators (e.g., cylinders) of the railway fastener removal system 100 may each include control ports for connection to control lines (hydraulic, pneumatic, electrical, etc., in various embodiments) and connection to the control system 201. In some embodiments, control valves with solenoids and electrical connections to one or more main processors of the control system 201 that may be located at the operators stations or at any suitable place.

The fastener removal system 100 may include a cylinder and slide assembly 128 configured to support the railway fastener extractors 104 and adjust positioning of the railway fastener extractors 104 laterally with respect to the rail 108, parallel to the rail 108, and diagonally with respect to the rail 108 to enable fine-tuned positional adjustment of the railway fastener extractors 104. Such compound, multi-axial movement to adjust to various positions during fastener extraction operations may advantageously increase the speed and efficiency of the process. The cylinder and slide assembly 128 may include one or more actuators, such as one or more lateral adjustment cylinders 129, adapted to selectively extend and retract in order to selectively push or pull the railway fastener extractors 104 along dual lateral shafts 156 of the frame assembly 126. With that action, the railway fastener extractors 104 may move along a plane that is perpendicular or substantially perpendicular to the rail 108. Some embodiments may employ a single lateral adjustment cylinder 129 adapted to selectively push or pull the railway fastener extractors 104 in unison, the railway fastener extractors 104 being connected to one another to allow movement in unison along the dual lateral shafts 156 when the lateral adjustment cylinder 129 is actuated. Other embodiments may employ multiple lateral adjustment cylinders 129 adapted to selectively push or pull individual railway fastener extractors 104 independently. In such embodiments, the railway fastener extractors 104 may not be connected to one another, but may each have a dedicated lateral adjustment cylinder 129 attached thereto in order to allow independent movement along the dual lateral shafts 156.

The cylinder and slide assembly 128 may include one or more actuators, such as one or more parallel adjustment cylinders 131, adapted to selectively extend and retract in order to selectively push or pull the railway fastener extractors 104 along pairs of dual parallel shafts 157 of the frame assembly 126. With that action, the railway fastener extractors 104 may move along a plane that is parallel or substantially parallel to the rail 108. Some embodiments may employ a single parallel adjustment cylinder 131 adapted to selectively push or pull the railway fastener extractors 104 in unison, the railway fastener extractors 104 being connected to one another to allow movement in unison along the dual parallel shafts 157 when the parallel adjustment cylinder 131 is actuated. Other embodiments may employ multiple parallel adjustment cylinders 131 adapted to selectively push or pull individual railway fastener extractors 104 independently. In such embodiments, the railway fastener extractors 104 may not be connected to one another, but may each have a parallel adjustment cylinder 131 attached thereto in order to allow independent movement along a pair of dual parallel shafts 157. While certain examples are disclosed herein, the fastener removal system 100 may be attachable to a variety of equipment, frames, workheads, and/or the like in various embodiments.

Each fastener extractor 104, the field-side fastener extractor 104-2 and the gage-side fastener extractor 104-1, may be configured a separate circuit so that each may move independently of the other of the pair. Each fastener extractor 104 may be independently directed by the control system 201 to perform fastener extraction to accommodate different patterns of fastener installations in the tie plates 114, which may be different for field-side holes and gage-side holes, from tie plate 114 to tie plate 114, and from track to track. Each fastener extractor 104 may be selectively adjusted in positioning and controlled to perform fastener extraction independently from the other, as well as simultaneously as the other, which may include each moving at a different or equivalent rates.

Accordingly, such selective operations may advantageously adapt to a variety of different fastener installation instances that may be encountered in the field. Such operations, as with all adjustments/operations of the system 100, may be autonomously performed by the system 100, or initiated remotely by an operator in an operator's cab. With the autonomous mode, the system 100 may automatically detect a given set of one or more fasteners with one or more sensors and operate the fastener extractors 104 to extract the set of one or more fasteners. The control system 201 may independently direct each fastener extractor 104 to adjust and perform fastener extraction according to the most efficient pattern for the particular fasteners 116 in each tie plate portion. Thus, each fastener extractor 104 may operate asymmetrically to facilitate asymmetrical fastener extractions, while efficiently avoiding unnecessary operations and adjustments. Further, in some instances, the obstructions such as railway components, electrical boxes, or other obstructions may create tight working spaces. Advantageously, the fastener extractor 104 may be controlled to asymmetrically adapt to avoid such obstructions and/or maneuver within such tight spaces.

In some embodiments, the system 100 may operate in a mode where the fastener extractors 104 always move simultaneously in a manner that maintains a balanced state. With that mode of operation, when one fastener extractor 104 moves one direction at a particular rate, the other fastener extractor 104 may move in the same or opposite direction at the same rate. The simultaneously movement of the fastener extractors 104 may maintain positional symmetry with respect to a distance between one or more centerlines between the fastener extractors 104 (e.g., a centerline perpendicular to the rail 108). Stated otherwise, the centerlines of the fastener extractors 104 may be maintained at the same distance from a centerline of the system 100.

In operation, the workhead, once positioned generally over a given railway tie 110, may utilize the cylinder and slide assembly 128 to further refine the position of the railway fastener extractors 104. Such positioning may be directed by operator or may be directed by control system 201 based at least in part on the sensor feedback described herein. After the initial positioning refinement stage, further positioning of the railway fastener extractors 104 may be effected by way of the cylinder and slide assembly 128 during fastener extraction operations over the railway tie 110. The various positioning operations may provide an extended range of movement for the extraction operations and may be directed by control system 201 based at least in part on the sensor feedback. Accordingly, such adjustments may allow for the railway fastener extractors 104 to perform fastener extraction with respect to multiple fasteners 116 in tie plates 114, which, as disclosed herein, may be performed under control of the control system 201 and may accommodate various fastener and fastener hole patterns.

Various embodiments may include a plurality of sensors (e.g., one or a combination of position sensors, measurement sensors, distance sensors, proximity sensors, cameras for optical recognition, image analysis, metrics, and recognition, motion sensors, light sensors, ambient light photo sensors, photodiode photo sensors, optical detectors, photo detectors, color sensors, and/or the like) attached to any suitable element of the fastener removal system 100 and disposed to capture data indicative of the positioning and/or other characteristics of aspects of the railway fastener extractors 104, the railway fasteners 116, the tie plates 114, holes in the tie plates 114, the anchors 114(*a*), 114(*b*), the ties 110, and/or the rail 108. By way of example, one or more sensors (e.g., a linear variable differential transformer (LVDT) sensor) may be coupled to the adjustment cylinders 129, 131 to detect positioning of the adjustment cylinders 129, 131. Likewise, one or more sensors (e.g., an LVDT sensor) may be coupled to each of the other cylinders (e.g., cylinders 132, 133) of the fastener removal system 100 to detect positioning of the respective cylinder. Disclosed embodiments may learn and infer positions of fasteners and fastener holes in tie plates based at least in part on the detected positions of the cylinders, with sensors having sensor sensitivity within a few thousandths of an inch. Additional disclosed embodiments may utilize such position sensors in conjunction with other types of sensors, such as one or a combination of the sensor types above, to learn and detect positions of fasteners and fastener holes, as well as other aspects described further herein.

In some embodiments, one or more of the adjustment cylinders 129 and/or 131 may correspond to trunnion-mounted cylinders. The one or more sensors may be coupled to a base end(s) of the adjustment cylinders 129 and/or 131. This may allow for ease of maintenance, such that the one or more sensors may be replaced without having to replace the entire cylinder.

In some embodiments, one or more sensors may be disposed on the workhead to have various fields of view to detect various features such as positions, surfaces, edges, contours, relative distances, and/or any other suitable indicia of the elements of the system 100 (e.g., the railway fastener extractors 104) and/or railway components (e.g., fasteners, anchors, tie plates, and/or railway ties). For example, the one or more sensors may include one or more cameras attached to the frame assembly 126 to have fields of view and capture images and/or other indicia of various aspects of the railway ties 110, the tie plates 114, the railway fasteners 116, the holes of the tie plates 114, and/or the rail 108. For instance, the one or more sensors may be attached to one or both plates 158 of the frame assembly 126 and/or a component of the upper structure of another part of the workhead.

Each of the sensors of disclosed embodiments may be communicatively coupled to a receiver of the control system 201 via wired or wireless communication channels. The sensors, receiver, and/or control system 201 may include any suitable sensors, controller(s), processor(s), memory, communication interface(s), and other components to facilitate various embodiments disclosed herein. The sensors, receiver, and/or control system 201 may include any sensor circuitry necessary to facilitate the various embodiments, including without limitation any one or combination of analog-to-digital converter circuitry, multiplexer circuitry, amplification circuitry, signal conditioning/translation circuitry, and/or the like. The data captured by the one or more sensors may be used by the control system 201 to detect positioning and facilitate system-directed positioning and installation operations of the hammer assemblies 120 and the anchor manipulator 102.

Figure 2C:
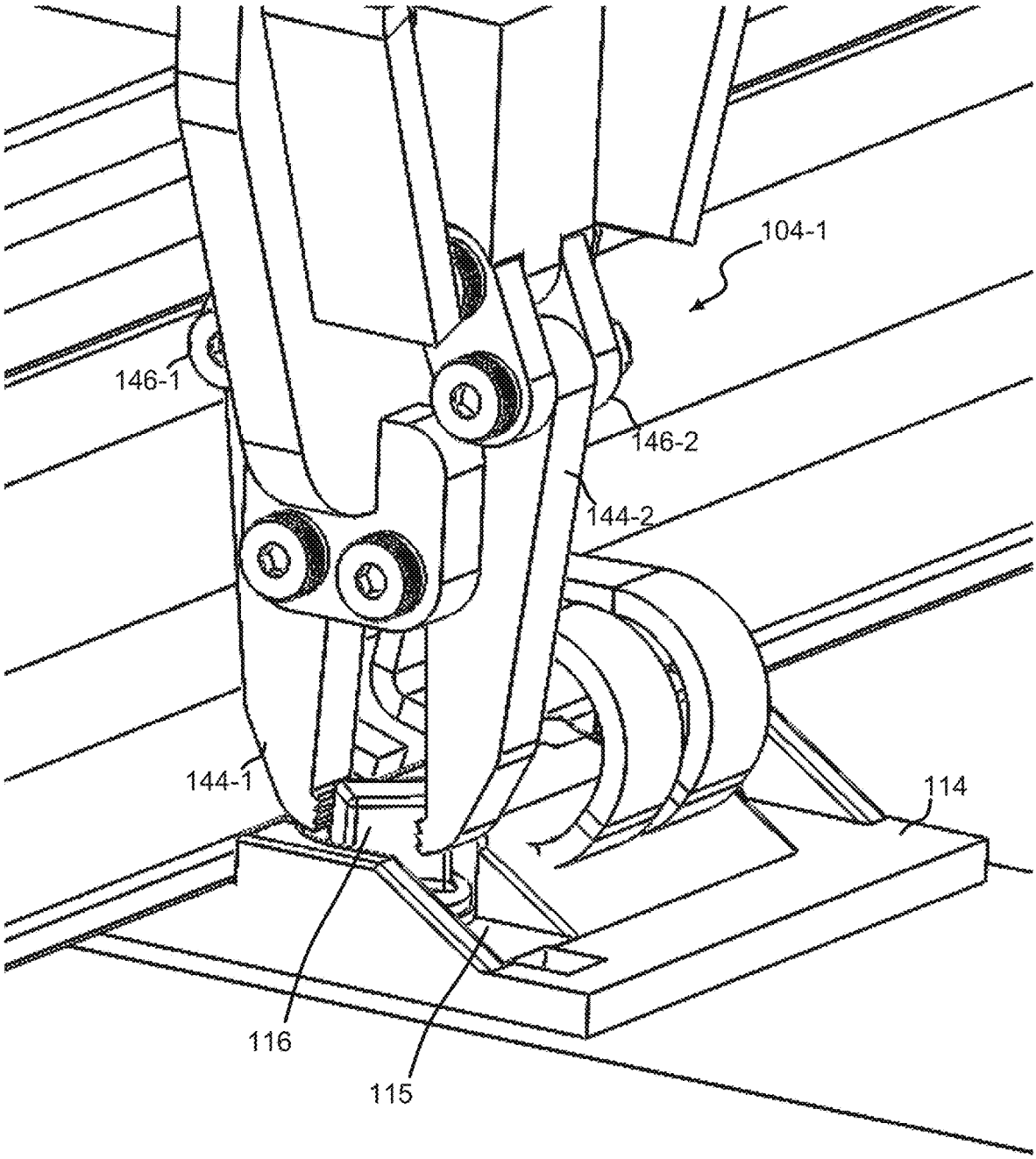
FIG. 2C depicts a partial close-up of the railway fastener extractor initially engaging the railway fastener, in accordance with certain embodiments of the present disclosure.
Figure 2D:
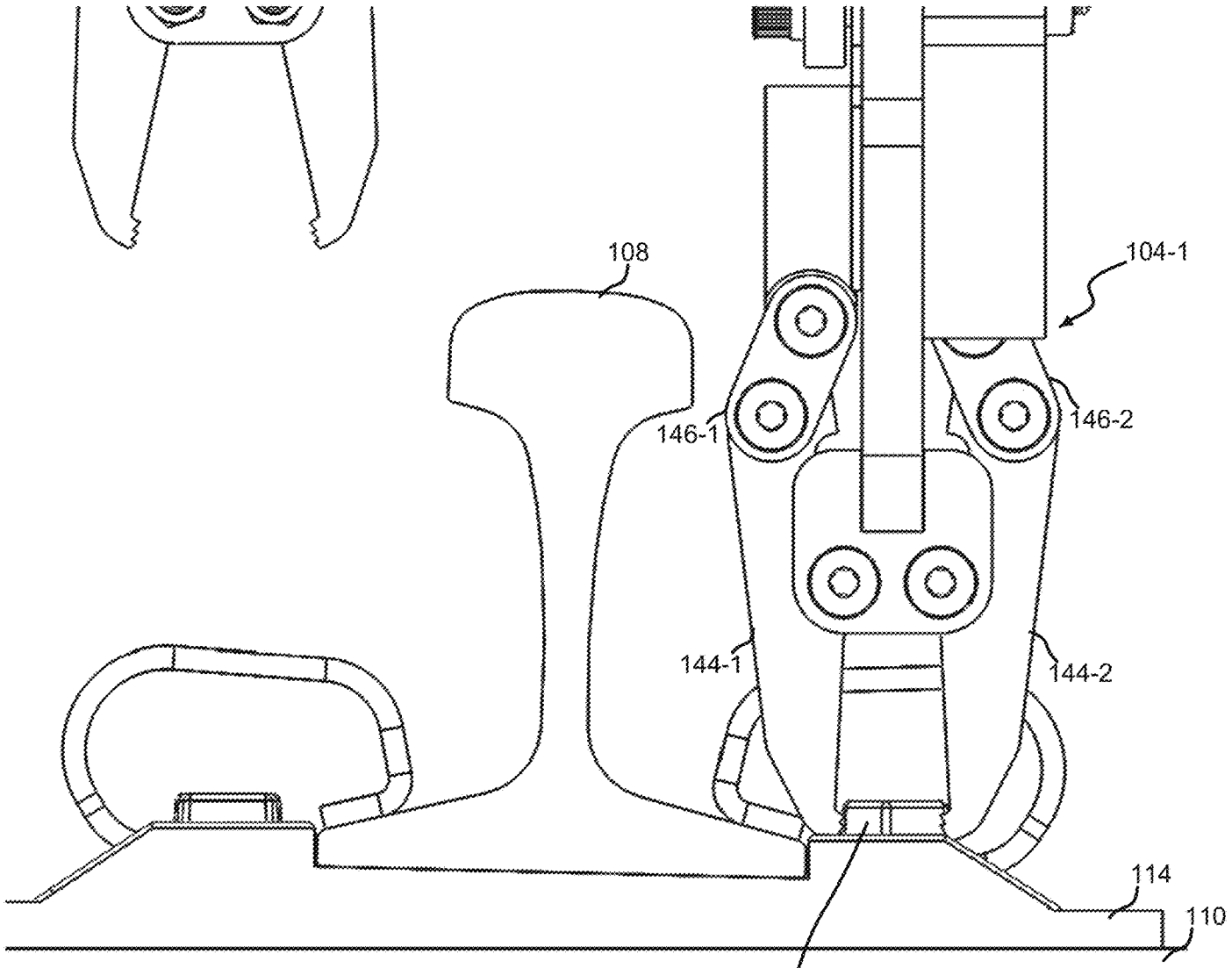
FIG. 2D depicts an end view of a partial close-up of the railway fastener extractor initially engaging the railway fastener, in accordance with certain embodiments of the present disclosure.

In FIG. 2B, the railway fastener extractor 104-1 is depicted in a non-engaged state prior to engaging the railway fastener 116. FIG. 2C depicts a partial close-up of the railway fastener extractor 104-1 initially engaging the railway fastener 116, in accordance with certain embodiments of the present disclosure. FIG. 2D depicts an end view of a partial close-up of the railway fastener extractor 104-1 initially engaging the railway fastener 116, in accordance with certain embodiments of the present disclosure.

Figure 3A:
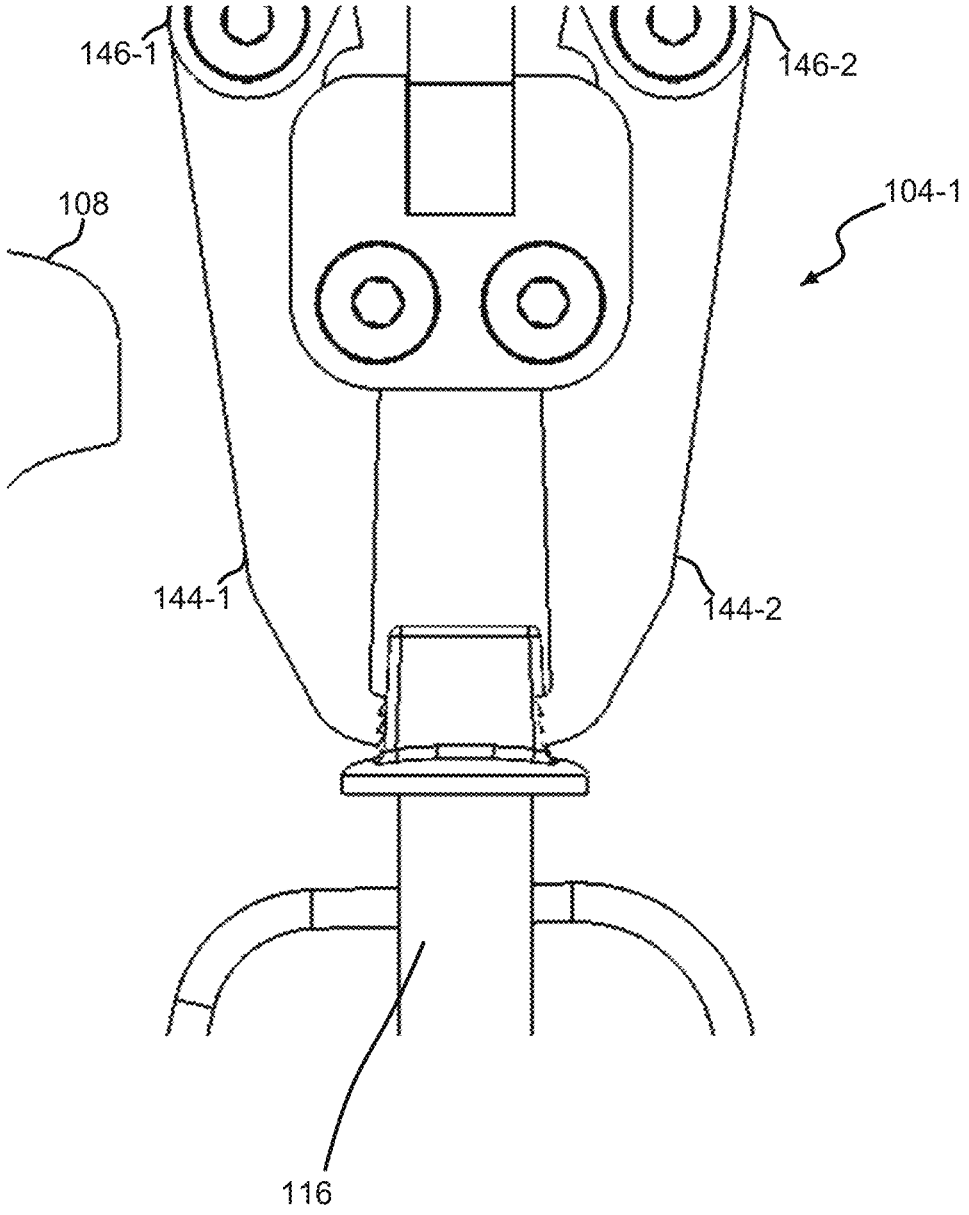
FIGS. 3A and 3B depict partial close-ups of the railway fastener extractor in extraction operations while employing different engagements of the railway fastener, in accordance with certain embodiments of the present disclosure.
Figure 3B:
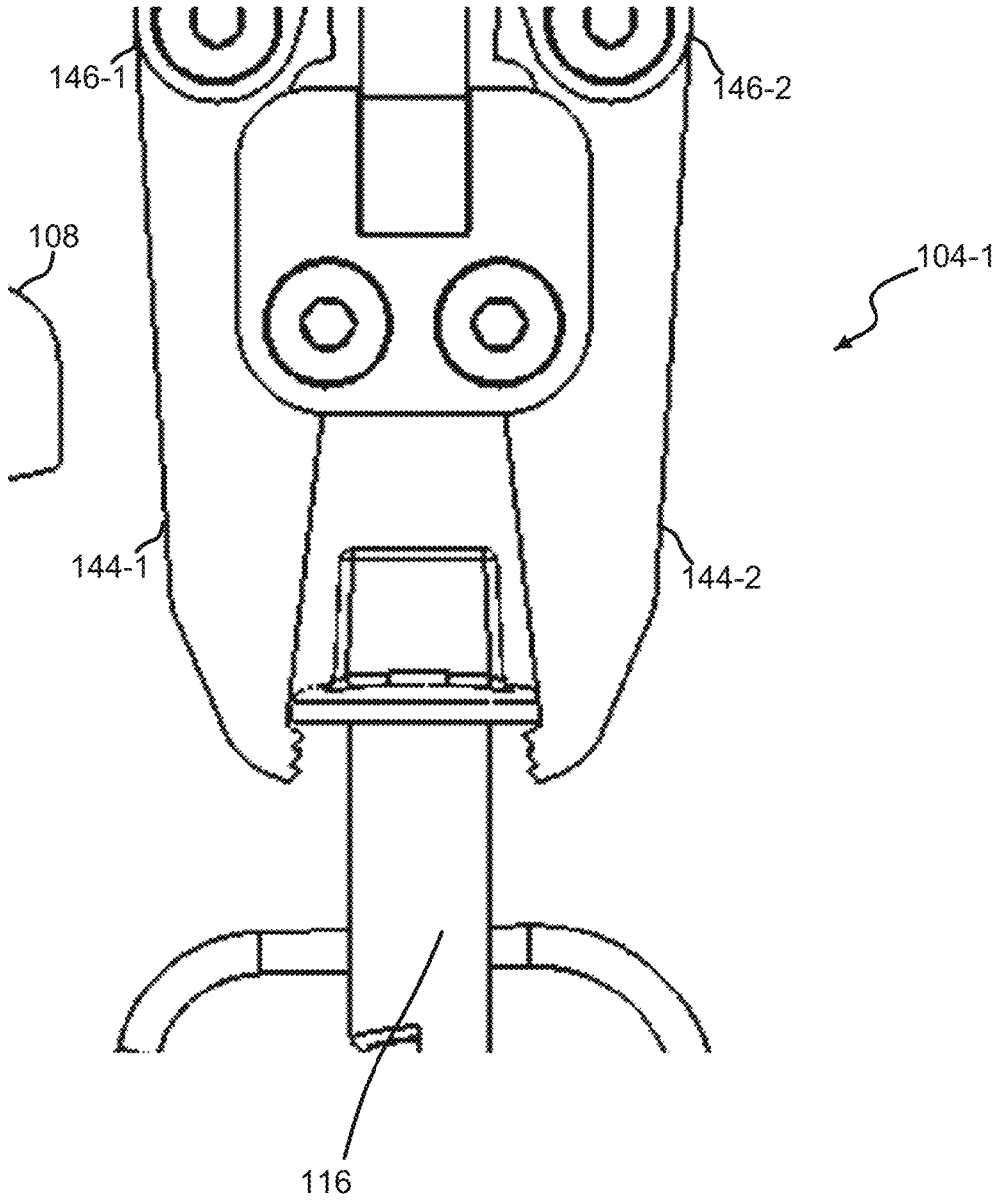

The railway fastener extractor 104 may be adapted to grip the head of the railway fastener 116, though the head may be in any orientation. Likewise, the railway fastener extractor 104 may be adapted to grip the head of the railway fastener 116 though the fastener 116 may be installed to varying extents with respect to the tie plate 114. For example, the head of the fastener 116 may be fully seated against the tie plate 114 when the fastener 116 is fully installed, or the fastener 116 may only be partially installed such that the head of the fastener 116 is not fully seated against the tie plate 114, and the railway fastener extractor 104 grip the head of the railway fastener 116 in any case. FIGS. 3A and 3B depict partial close-ups of the railway fastener extractor 104-1 in extraction operations while employing different engagements of the railway fastener 116 to accommodate different extents to which the railway fastener 116 may be installed against the tie plate 114, in accordance with certain embodiments of the present disclosure.

In some cases, the orientation of head may change as the railway fastener extractor 104 engages it, and the railway fastener extractor 104 may continue to close on the head until a suitable and stable grip on the head is attained. In some embodiments, the forces imparted to the head of the lag screw may be sufficient that the railway fastener extractor 104 bites into the head of the lag screw. Having attained a grip on the railway fastener 116, the railway fastener extractor 104 may be configured to remove the railway fastener 116 by pulling the railway fastener 116 upward away from the tie plate 114. The railway fastener extractor 104 may pull the railway fastener 116 with sufficient force to rip the railway fastener 116 out of threaded engagement with the railway tie 110, in instances where the fully threaded engagement exists with respect to a railway tie 110 (e.g., when the engagement has not been stripped) and, in some cases, with respect to a tie plate 114.

Figure 4A:
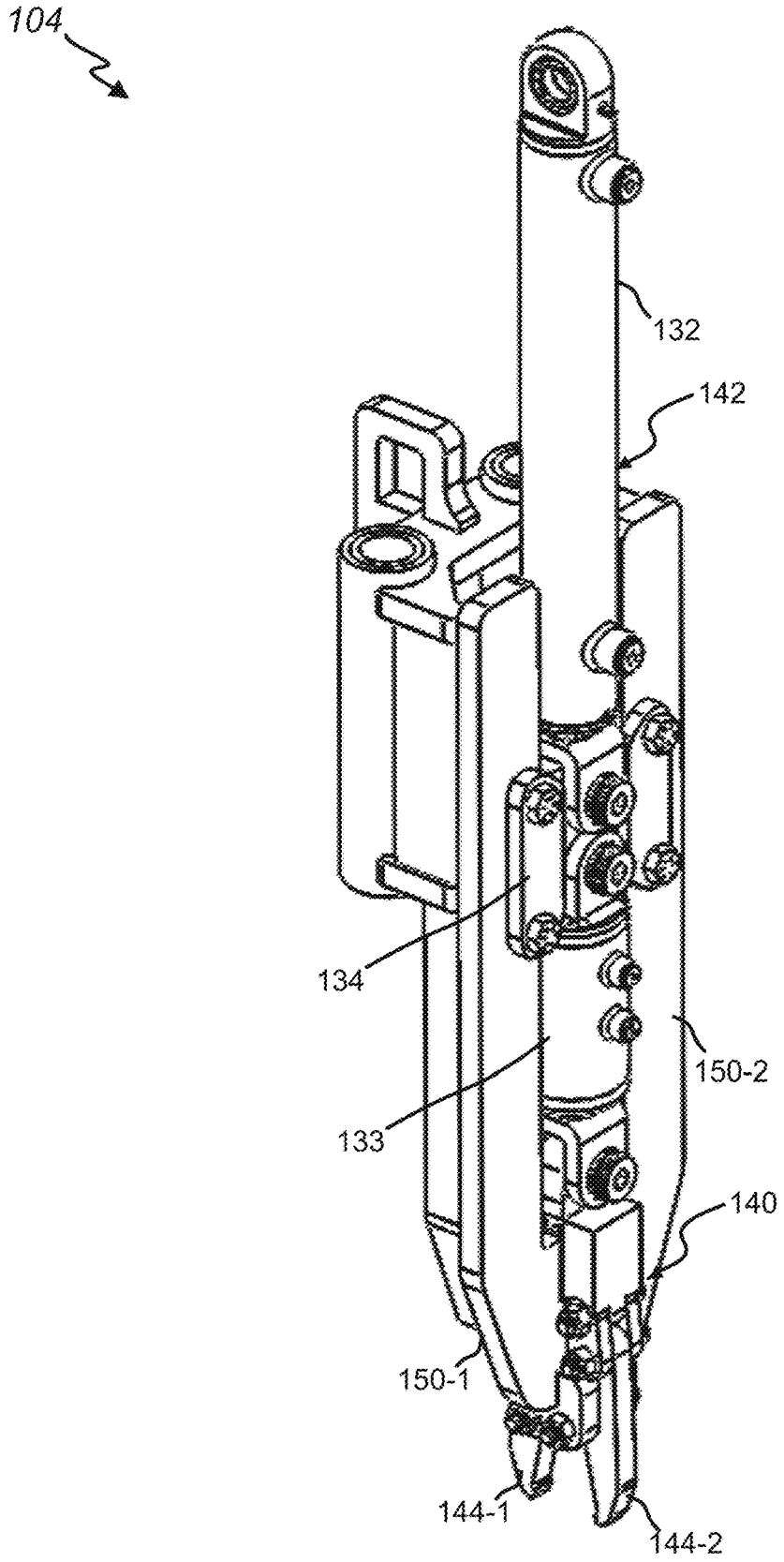
FIG. 4A depicts a perspective view of the railway fastener extractor, in accordance with certain embodiments of the present disclosure.
Figure 4B:
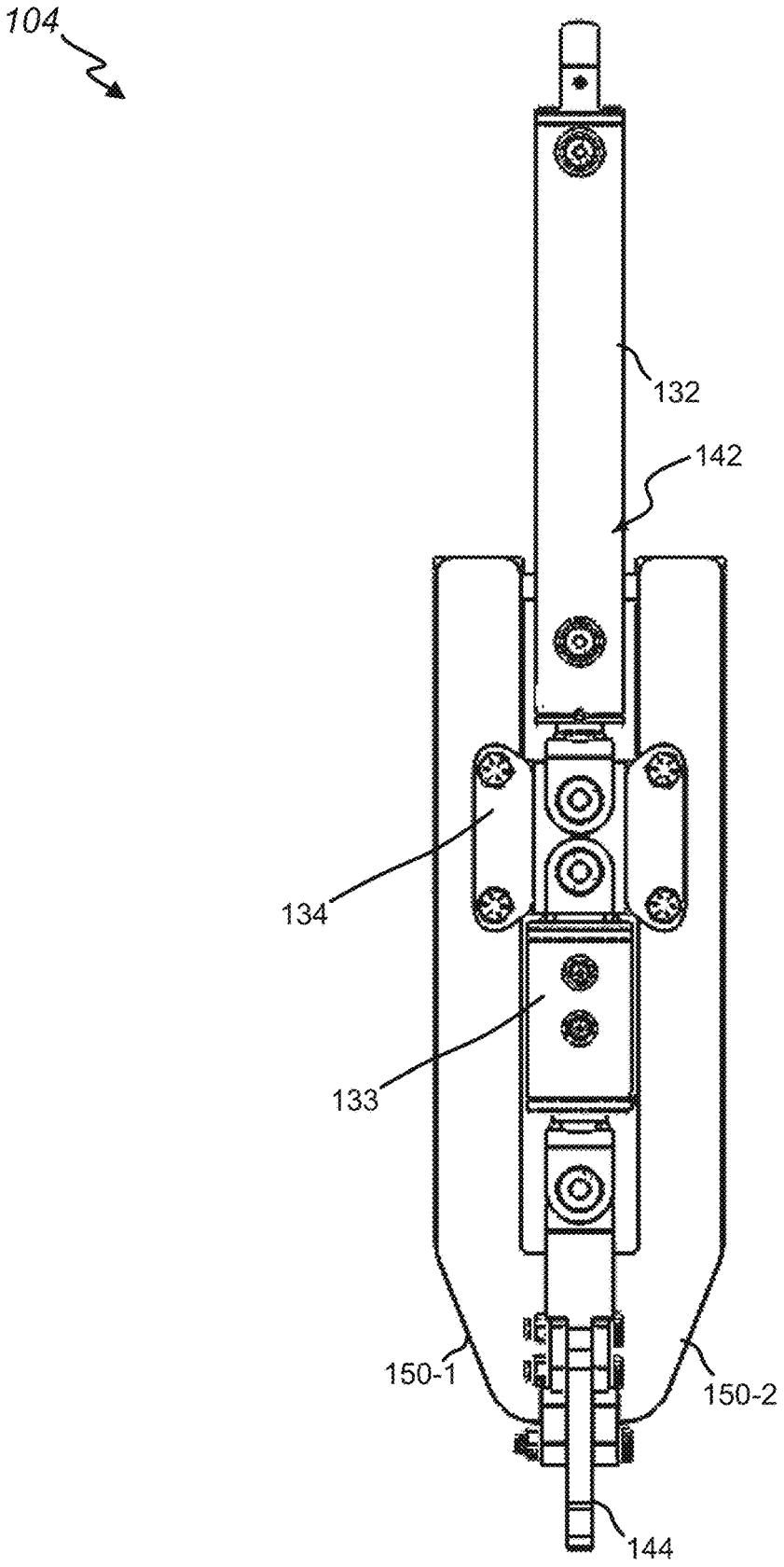
FIG. 4B depicts a side view of the railway fastener extractor, in accordance with certain embodiments of the present disclosure.
Figure 5A:
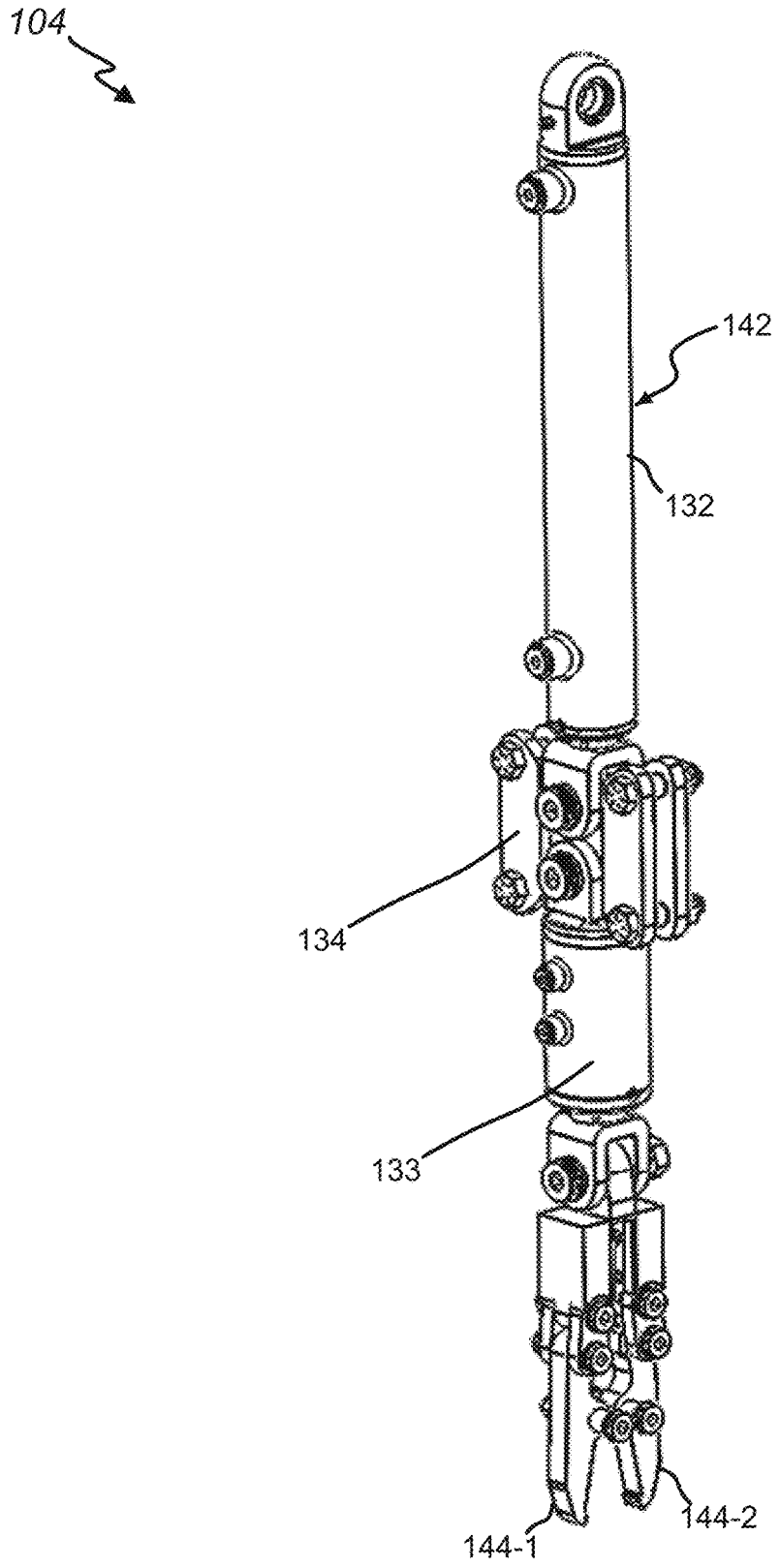
FIG. 5A depicts partial perspective views of a linkage system of the railway fastener extractor, in accordance with certain embodiments of the present disclosure.
Figure 5B:
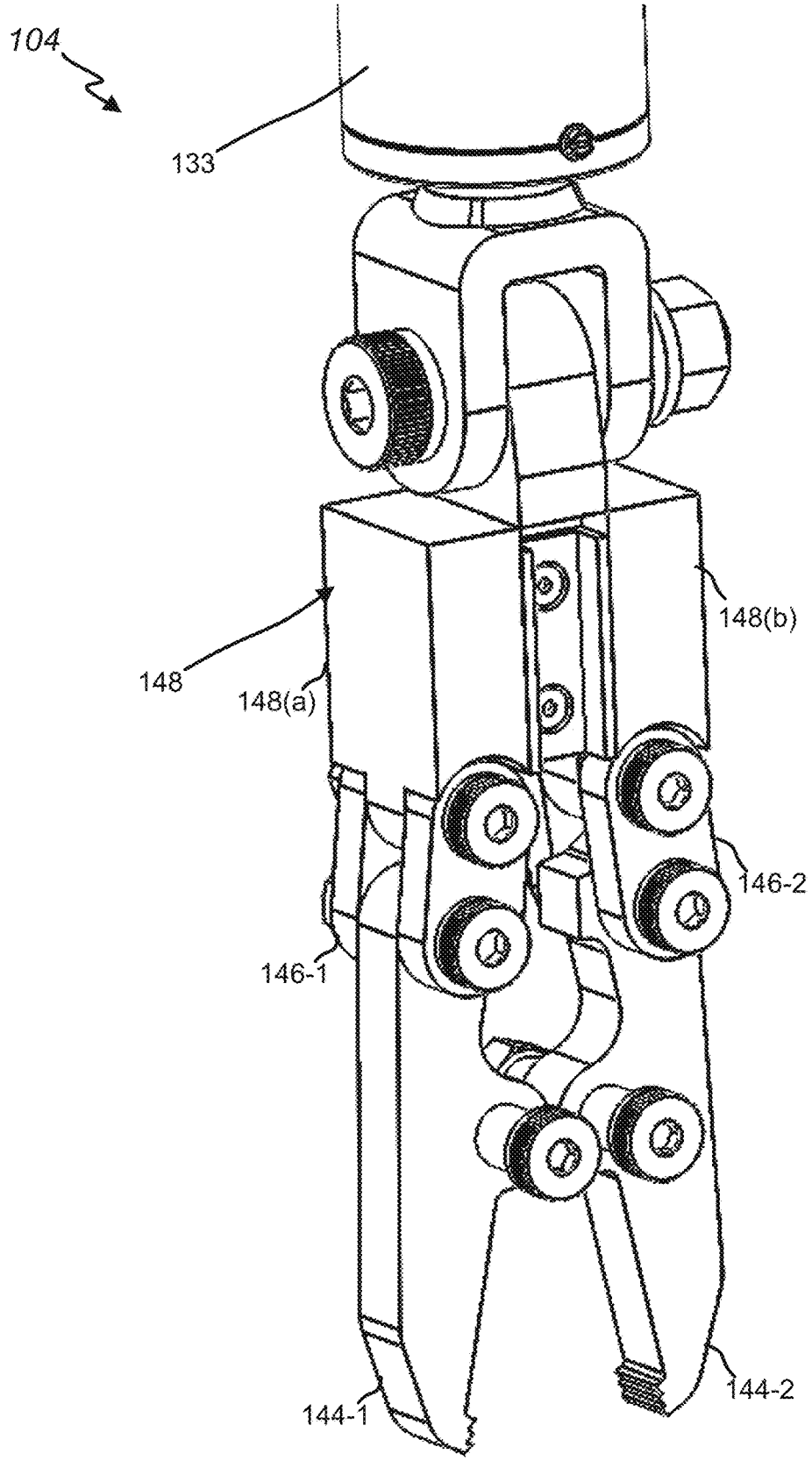
FIG. 5B depicts partial perspective views of a linkage system of the railway fastener extractor, in accordance with certain embodiments of the present disclosure.
Figure 5C:
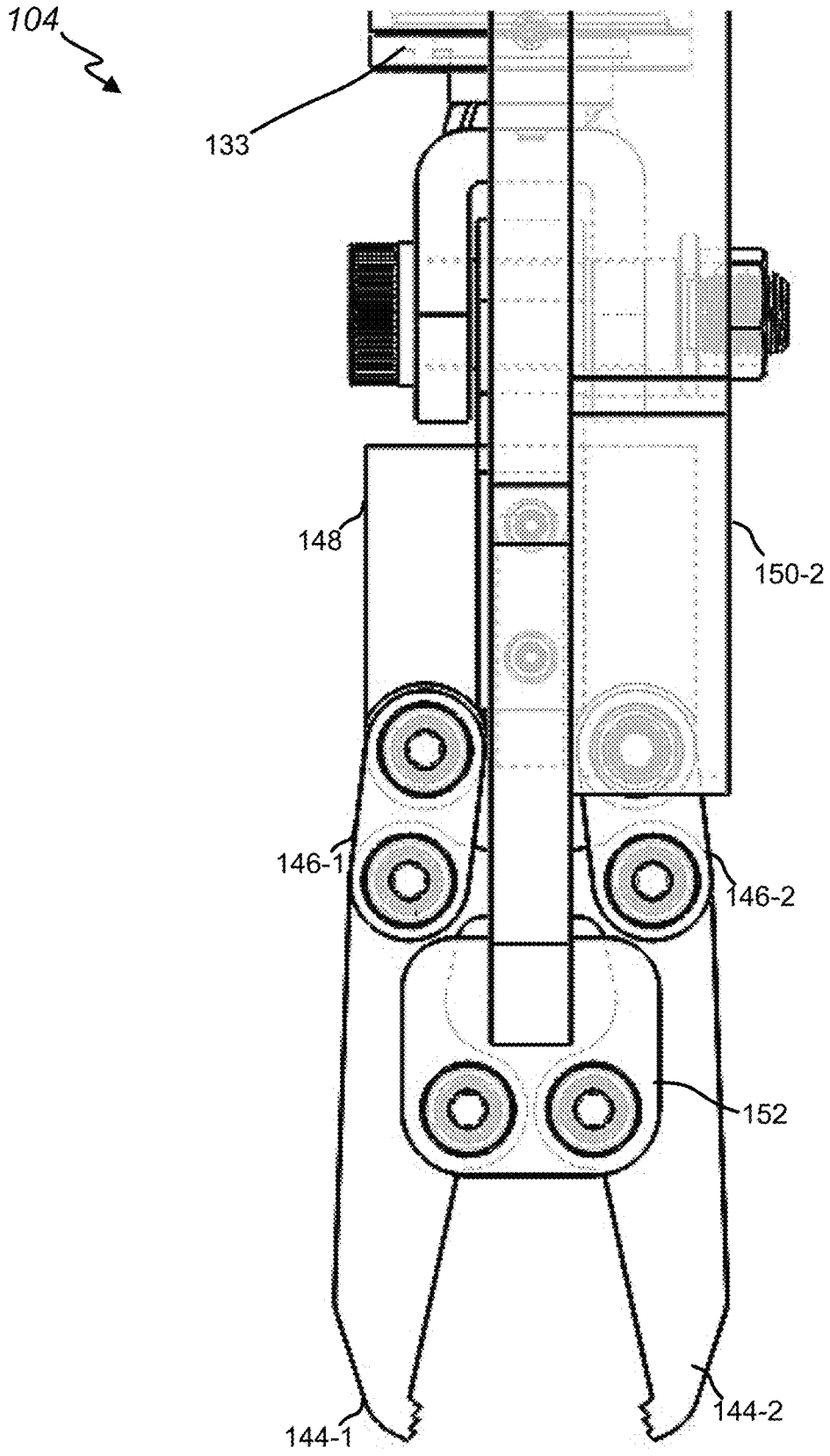
FIG. 5C depicts a partial end view of the linkage system, in accordance with certain embodiments of the present disclosure.

FIG. 4A depicts a perspective view of the railway fastener extractor 104, in accordance with certain embodiments of the present disclosure. FIG. 4B depicts a side view of the railway fastener extractor 104, in accordance with certain embodiments of the present disclosure. FIGS. 5A and 5B depict partial perspective views of a linkage system 140 of the railway fastener extractor 104-1, in accordance with certain embodiments of the present disclosure. FIG. 5C depicts a partial end view of the linkage system 140, in accordance with certain embodiments of the present disclosure.

The linkage system 140 may be configured to grip the railway fasteners 116 with a pair of claws 144. Each claw 144 may be formed to have a gripping surface that may include jagged edges, teeth, striations, ribs, spikes, and/or the like to engage, bite, or otherwise grip the railway fasteners 116. The pair of gripper claws 144 may be formed such that the pair can grab the upper portion of a fastener head, e.g., as is illustrated by FIG. 3A. The pair of gripper claws 144 may also be formed to fit around the "washer" portion of certain fasteners that may correspond to a circular base portion of the fastener head, e.g., as is illustrated by FIG. 3B. In this manner, portions of the gripping surfaces can fit immediately under the washer to produce a "ledge" which can help prevent slippage of the gripper claws 144 on the fastener and permit higher vertical pulling force to be applied to the fastener during removal.

Referring again to FIG. 5B, the linkage system 140 may include linkages 146 configured to enable sufficient forces to be imparted with the claws 144. The linkages 146 may be pivotably attached to one or more linkage components 148 and pivotably attached to the claws 144 via suitable fasteners. The linkages 146 may be symmetrically arranged with respect to the longitudinal axis of the railway fastener extractor 104. The components of the linkage system 140 may be dimensioned to impart high forces, while allowing the linkage system 140 to work within tight physical constraints beside a rail 108. For example, as illustrated in FIGS. 2B-2D, when the claws 144 are closed about a head of a railway fastener 116, the linkage system 140 may not make contact with the rail 108. The linkages 146, by way of example, may be dimensioned such that there is approximately a one-inch distance between the centerpoints of the pivot holes of the linkages 146. Further, in some embodiments, the claws 144 may be dimensioned to fit at least partially within a channel 115 of a tie plate 114 in order to engage heads of railway fasteners 116 that may be partially or fully inset within the channel 115. One example of the channel 115 is illustrated with FIGS. 2B and 2C. In various instances, the space within which the claws 144 may need to work may span less than approximately one inch at most. By applying symmetrical forces on opposing sides of a given railway fastener 116 and by forming the components of the linkage system 140 to be compact, the stress imparted on the various components may be controlled.

Referring again to FIGS. 4A-5C, the railway fastener extractor 104 may include a multiple cylinder system 142. The multiple cylinder system 142 may include a lift cylinder 132 arranged to raise and lower the linkage system 140. Accordingly, the linkage system 140 may be raised and lowered through a range of retracted and extended positions to allow for stowing of the a linkage system 140, deploying the linkage system 140, and making fine-tuned adjustments of the linkage system 140 to precisely address railway fasteners 116 as disclosed in various embodiments herein. According to some embodiments, when the lift cylinder 132 is fully retracted, the claws 144 may be in stowed position; and, when the lift cylinder 132 is partially or fully extended, the claws 144 may be on over a railway fastener 116 in a working position.

The multiple cylinder system 142 may include a claw actuator, such as a claw actuation cylinder 133. The claw actuation cylinder 133 may be coupled with the lift cylinder 132 in tandem such that each share a longitudinal axis. Hence, the multiple cylinder system 142 may include a tandem cylinder system.

The upper end of the claw actuation cylinder 133 may be attached via a suitable fastener to an intermediate connecting bracket 134 which may be shared with the lift cylinder 132, with the lower end of the lift cylinder 132 being attached via a suitable fastener to the connecting bracket 134 as well. Selective actuation of the claw actuation cylinder 133 may cause the gripper claws 144 to selectively close or open. The multiple cylinder system 142 may ensure that, when the claw actuation cylinder 133 is actuated, it applies the gripper force to the gripper claws 144 so that the gripper claws 144 are maintained in a consistent position and so that the gripper claws 144 hold a fastener head with a consistent force, despite where the lift cylinder 132 is in its stroke. By retracting the lift cylinder item 132, a vertical force may be applied to extract the railway fastener 116 without causing an opening force on the gripper claws 144 which are gripping the fastener head. Accordingly, the claw actuation cylinder 133 may facilitate operation of the gripper claws 144 independent of the operation of the lift cylinder item 132. The linkage system 140 may include linkages opposingly arranged with respect to a longitudinal plane of the extractor 104. For example, the linkages may be opposingly arranged with respect to the longitudinal axis the extractor 104. Additionally, the linkages may be symmetrically arranged with respect to a longitudinal plane of the extractor 104, which may include being symmetrically arranged with respect to the longitudinal axis the extractor 104.

The linkages may include linkages 146 and one or more linkage components 148. A given linkage component 148 may be guided by support brackets 150 so that the linkage component 148 moves in parallel to a longitudinal axis of the railway fastener extractor 104 (which may correspond to vertical movement, up and down) when the claw actuation cylinder 133 is actuated. By way of example, support brackets 150 may, in some embodiments, include one or more channels to guide the linkage component 148, allowing the linkage component 148 to slide vertically along the channel(s). The example embodiment depicted includes a single, integral linkage component 148 attached to the claw actuation cylinder 133 via a suitable fastener. Alternative embodiments may include a pair of linkage components 148. In either case, the linkage component 148 may be formed to include portions 148(*a*), 148(*b*) opposingly arranged with respect to the longitudinal axis of the railway fastener extractor 104. The portions 148(*a*), 148(*b*) of the linkage component 148 may be symmetrical.

With the actuation of the claw actuation cylinder 133, a force from the claw actuation cylinder 133 may be bifurcated by way of the linkage component 148 and the linkages 146 to selectively open and close the claws 144, pivoting the claws 144 about the pivots points of a coupler 152. For example, the longitudinal forces (e.g., forces in the downward direction with respect to the depicted orientation of FIG. 5C) imparted via the claw actuation cylinder 133 and the linkage component 148 symmetrically pushes the linkages 146 longitudinally and laterally to cause the claws 144 to symmetrically close.

The example deployed states depicted in the figures are not limiting; other deployed states may be employed by various embodiments. In certain embodiments as depicted, one or more pairs of the railway fastener extractors 104 may be disposed in an opposing arrangement. The railway fastener extractors 104 may be disposed on opposite sides of the rail 108. Some embodiments may allow for selective and independent operation of the railway fastener extractors 104-1, 104-2. As such, one of the railway fastener extractors 104-1, 104-2 may be deployed to extract a set of one or more railway fasteners 116 while the other of the railway fastener extractors 104-1, 104-2 may be operated independently to extract a different set of one or more railway fasteners 116 or may remain in the stowed position.

In certain embodiments, the railway fastener removal system 100 may be operable to repeatedly perform fastener-pulling operations. The fastener-pulling operations may include a step of aligning the railway fastener removal system 100 over a given fastener 116, e.g., via actuation of one or more cylinders of the cylinder and slide assembly 128 that may be adapted to allow for horizontal adjustment of the fastener-pulling workhead in any suitable direction with respect to the rail 108. The fastener-pulling operations may further include steps of lowering one or more of the railway fastener extractors 104 via operation of one or more lift cylinders 132 to a level of the fastener 116, engaging a head of the fastener 116 with the claws 144 via operation of the claw actuation cylinder 133 and the linkage system 140, ripping the fastener 116 away from the railway tie 110 via maintained forces applied with the claw actuation cylinder 133 and the linkage system 140 and via lifting force applied with the one or more lift cylinders 132, releasing the fastener 116 via operation of the claw actuation cylinder 133 and the linkage system 140, and readjusting the railway fastener extractor(s) 104 to allow for a subsequent fastener pulling operation directed to another fastener 116.

According to certain embodiments, the railway fastener extractor 104 may be lowered to a working position with each set of one or more components associated with each railway tie 110, and may be raised to a stowed position or another position suitable for transition between railway ties 110 to create or increase clearance with respect to railway components. Such embodiments may allow for increased adaptability to a variety of working conditions. However, certain embodiments may allow for the railway fastener extractor 104 to remain in a lowered working position or to be partially raised as the system 100 transitions between railway ties 110 to make component adjustments associated with a plurality of railway ties 110. Such embodiments may allow for increased speed and efficiency in making component adjustments with respect to a large number of railway ties 110. Some of such embodiments may include adjusting the railway fastener extractors 104 to a vertical state or an outward state to create or increase clearance with respect to railway components to accommodate transitions between railway ties 110 while the railway fastener extractor 104 remains in a lowered working position.

Figure 6:
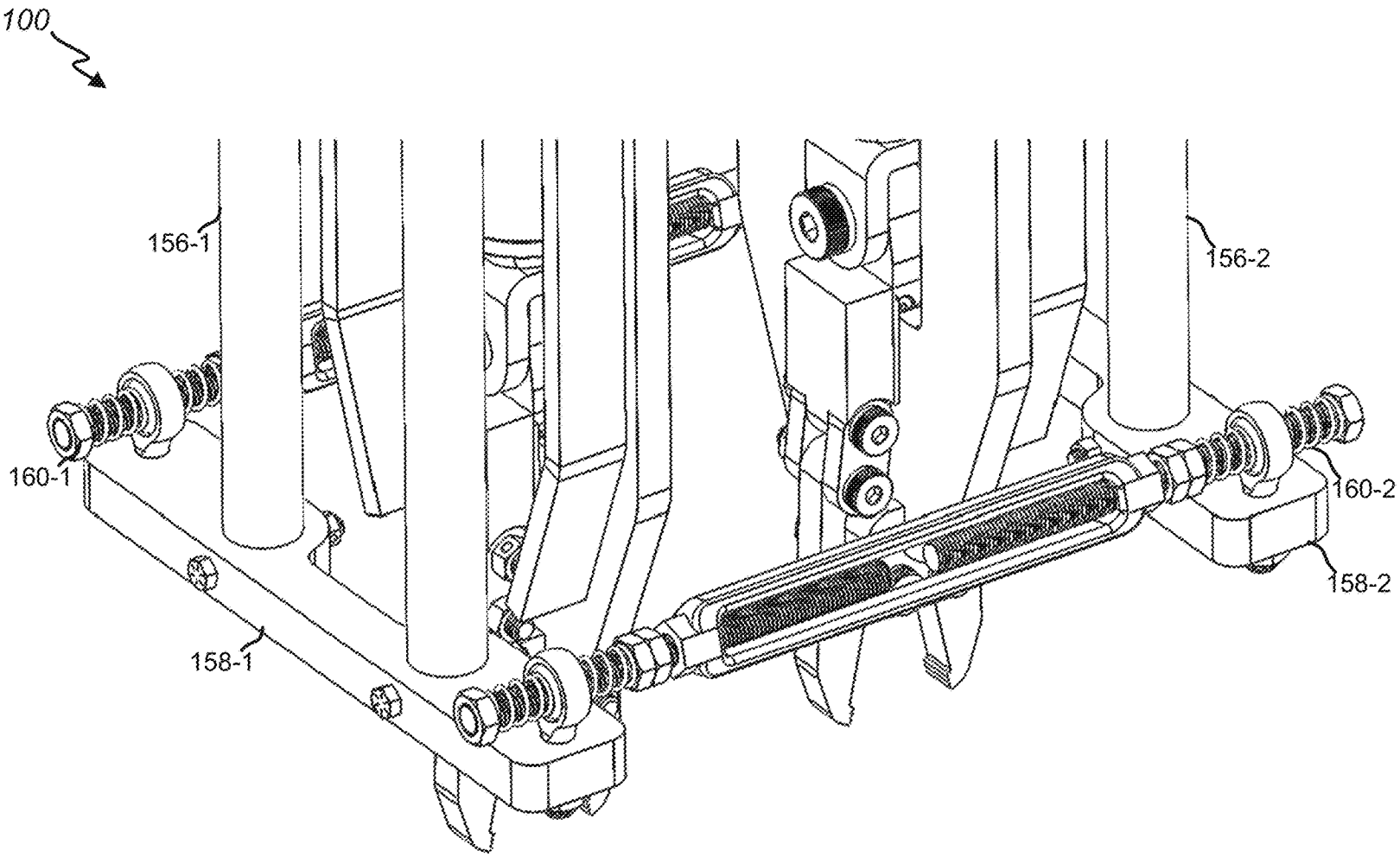
FIG. 6 depicts a partial close-up of an end portion the railway fastener removal system, in accordance with certain embodiments of the present disclosure.

The railway fastener removal system 100 may be configured to allow for freedom of movement. FIG. 6 depicts a partial close-up of an end portion the railway fastener removal system 100, in accordance with certain embodiments of the present disclosure. As depicted, the railway fastener removal system 100 may include the parallel slide shafts 156 that are slidably engaged with the railway fastener extractors 104 so as to allow the railway fastener extractors 104 to slide along the slide shafts 156 when raised or lowered by the cylinders 132. The pair of the slide shafts 156 may be connected with a plate 158 that traps ends of the slide shafts 156 to support the slide shafts 156 maintain parallel spacing of the slide shafts 156. Advantageously, each dual-shaft configuration may provide slidable lateral support for the railway fastener extractors 104 to react against lateral loads.

One or more adjustable couplings 160 may flexibly couple the plates 158. The adjustable couplings 160 may, in some embodiments, correspond to spring-loaded turn buckles. The adjustable couplings 160 may allow for flex adjustment of the railway fastener extractors 104. For example, the railway fastener extractors 104 may be allowed to move laterally. The railway fastener extractors 104 may move in toward each other or outward away from each other. This lateral adjustment is allowed to occur dynamically as needed by the overall assembly as the gripper claws close around the head of a railway fastener 116. This dynamic alignment flexibility allows the grippers to effectively and evenly grasp the head of a railway fastener 116 no matter its rotation or angular (vertical) orientation. There is an infinite number of possible positions which the head of a railway fastener 116 may take, therefore, the flexibility of the gripper assembly as a whole to self-align is important. Also, the upper end of the slide shafts item 156 have adjustable stops to allow clearance (slop) in their pinned connections at the top. The adjustable clearance at the top of each slide shaft ensures that they can rotate and allow the lower end and plate 158 to move laterally as the system attempts to self-align while closing around the head of a railway fastener 116.

Figure 7:
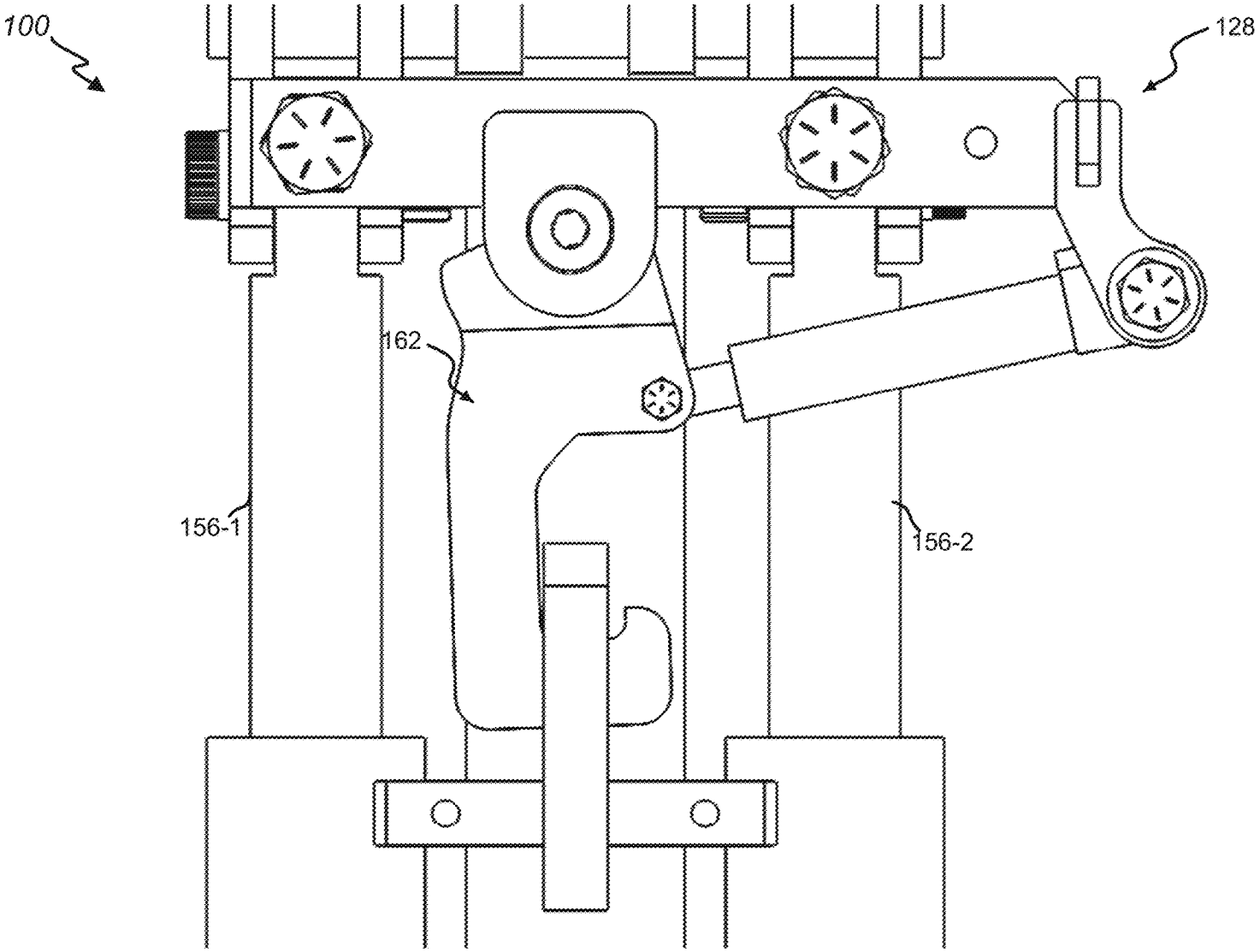
FIG. 7 depicts a partial close-up of another portion the railway fastener removal system including the top ends of the slide shafts, in accordance with certain embodiments of the present disclosure.

FIG. 7 depicts a partial close-up of another portion the railway fastener removal system 100 including the top ends of the slide shafts 156, in accordance with certain embodiments of the present disclosure. The slide shafts 156 may be pivotably connected to a support member of the cylinder and slide assembly 128 to allow for pivoting action. Accordingly, the slide shafts 156 may pivot and flexibly adjust so that the railway fastener extractors 104 can self-adjust as needed to grip railway fasteners 116. In this manner, imperfect alignments due to various orientations of heads of the railway fastener 116 and/or uneven surfaces and alignments of railway components can be accommodated by the self-adjusting railway fastener extractors 104. Also as depicted, when a railway fastener extractor 104 is in a stowed position, lockup components 162 may be actuated by an actuator 164 to place a hook and slot assembly in a locked position to lock the railway fastener extractor 104 in the stowed position.

Figure 8A:
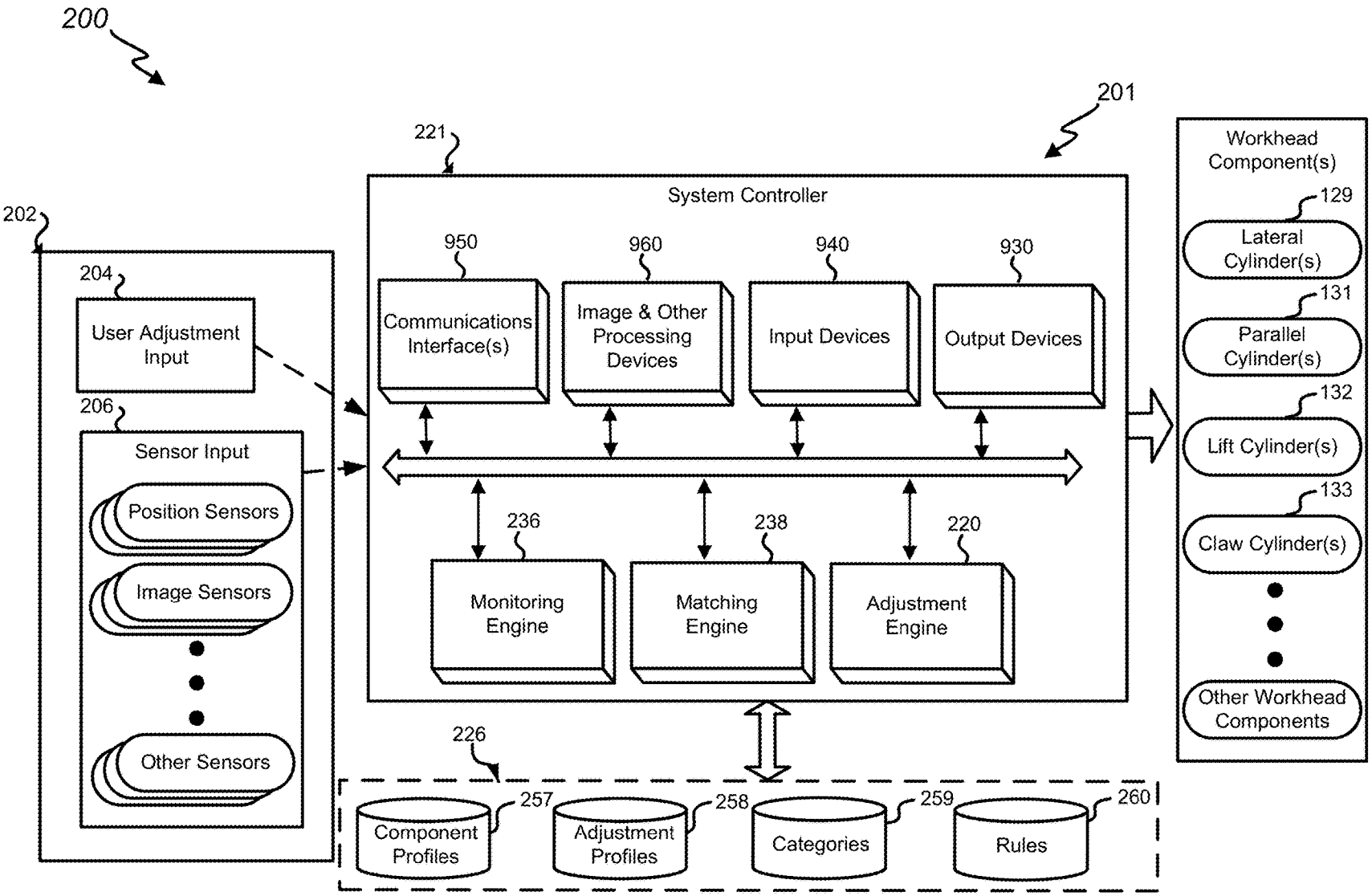
FIG. 8A illustrates a subsystem corresponding to the control system to facilitate railway faster removal system automation control, in accordance with certain embodiments of the present disclosure.

FIG. 8A illustrates a subsystem 200 corresponding to the control system 201 to facilitate railway fastener extractor automation control, in accordance with certain embodiments of the present disclosure. In some embodiments, the subsystem 200 may be included in or otherwise control aspects of the railway fastener removal system 100. While the subsystem 200 is illustrated as being composed of multiple components, it should be understood that the subsystem 200 may be broken into a greater number of components or collapsed into fewer components. Each component may include any one or combination of computerized hardware, software, and/or firmware. In various embodiments, the subsystem 200 includes a gripper-puller controller and/or control engine 221, executed by one or more processors and may be implemented with any suitable device, such as a computing device, a standalone system controller device, a system controller device integrated with another device, such as operator station control device, etc. The system controller 221 may be located in or about the operator's cab. In some embodiments, the system controller 221 may be located at the workhead, being attached to the upper structure of the workhead.

The system controller 221 may include communications interfaces 950, image processing and other processing devices 960, input devices 940, output devices 930, and other components disclosed herein. Some of such components are discussed further in reference to FIG. 9. As illustrated in FIG. 8A, the system controller 221 may be communicatively coupled with interface components and communication channels (which may take various forms in various embodiments as disclosed herein) configured to receive adjustment input 202 via the communications interfaces 950 and/or input devices 940. As depicted, the adjustment input 202 may include user adjustment input 204. The user input 204 may include real-time user control via a user interface—e.g., one or more interfaces provided via the operator station. User input may be provided by way of one or more user input devices, such as a touchscreen, a mouse, a track ball, a keyboard, buttons, switches, control handles, and/or the like.

The adjustment input 202 may further include the sensor input 206 disclosed herein. As described above, disclosed embodiments of the fastener removal system 100 may include a plurality of sensors (e.g., position sensors, measurement sensors, distance sensors, proximity sensors, cameras for optical recognition, image analysis, metrics, and recognition, and/or the like) attached to any suitable structural element of the system 100. For example, one or more sensors may be attached to one or more of the cylinders and/or the frame 126 of the fastener removal system 100 and disposed to capture sensor data that facilitates automatic alignment and extraction operations by detecting various features such as positions, appearance, surfaces, edges, contours, relative distances, and/or any other suitable indicia of the elements of the system 100 (e.g., the fastener extractors 104) and/or railway components (e.g., fasteners, anchors, tie plates, railway ties, the rail, and/or the like) in accordance with disclosed embodiments.

For example, in disclosed embodiments, signals from a plurality of sensors may be utilized by the control system 201 to detect movement and positioning of the workhead components, such as the components of the fastener extractors 104. Additionally, signals from the plurality of sensors may be utilized by the control system 201 to detect and recognize fasteners, anchors, tie plates, tie plate holes, railway ties, the rail, and/or the like railway components. Further, signals from the plurality of sensors may be utilized by the control system 201 to detect obstructions, such as electrical boxes, stones, and other foreign objects. Hence, the sensors may be disposed to capture and sense data that facilitates one or a combination of the automatic detection, recognition, learning, positioning, installation, and patterning features disclosed herein.

Sensors and control units may be coupled and connected in a serial, parallel, star, hierarchical, and/or the like topologies and may communicate to the control system 201 via one or more serial, bus, or wireless protocols and technologies which may include, for example, WiFi, CAN bus, Bluetooth, I2C bus, ZigBee, Z-Wave and/or the like. For instance, one or more sensors and control units may use a ZigBee® communication protocol while one or more other devices communicate with the receiver using a Z-Wave® communication protocol. Other forms of wireless communication may be used by sensors, control units, and the control system 201. For instance, sensors, control units, and the control system 201 may be configured to communicate using a wireless local area network, which may use a communication protocol such as 802.11.

In some embodiments, a separate device may be connected with the control system 201 and/or the operator's station to enable communication with railway component adjustment devices. The separate device may be configured to allow for Zigbee®, Z-Wave®, and/or other forms of wireless communication. In some embodiments, the control system 201 and/or the operator's station may be enabled to communicate with a local wireless network and may use a separate communication device in order to communicate with sensors and control units that use a ZigBee® communication protocol, Z-Wave® communication protocol, and/or some other wireless communication protocols.

Utilizing the processing devices 960, the subsystem 200 may process sensor input 206 and analyze the sensor input 206 to provide for the railway component adjustment automation control of one or more aspects of the fastener removal system 100. The sensor input 206 may be captured by any or combination of the sensors/detectors disclosed herein to facilitate detection, recognition, and differentiation of one or combination of types of features, railway components, positions, objects, appearances, movements, directions of movements, speeds of movements, device use, and/or the like. For example, the sensor input 206 may include location data, such as any information to facilitate detection, recognition, and differentiation of one or combination of locations of one or more components of the fastener removal system 100, such as components of the fastener extractors 104, and/or railway components (e.g., fasteners, anchors, tie plates, railway ties, the rail, and/or the like) in and/or about the fastener removal system 100.

The railway component adjustment automation control may direct the fastener extraction processes disclosed herein. In some embodiments, a monitoring engine 236 may gather and process adjustment input 202 to facilitate creation, development, and/or use of railway adjustment profiles 226. The railway adjustment profiles 226 may include railway component profiles 257, such as the tie plate profiles and fastener profiles disclosed herein. The railway adjustment profiles 226 may include adjustment action profiles 258, such as the fastener extraction processes disclosed herein. The railway adjustment profiles 226 may include categories 259, such as reference image and characteristic data compiled, utilized, and refined via machine learning to facilitate the recognition, characterization, and categorization of railway components disclosed herein (e.g., comparison sensor data, such as images, to facilitate sensor recognition of fasteners). The railway adjustment profiles 226 may include rules 260 for handling the thresholds, operator selections, exceptions, inconsistencies, nonconformities, errors, operational modes, and/or the like disclosed herein.

The railway adjustment profiles 226 may include any suitable data that may be captured to indicate, infer, and/or determine component and adjustment identification, actions, locations, temporal factors, contexts, and patterns for components and/or adjustments. In various embodiments, the railway adjustment profiles 226 may be implemented in various ways. For example, one or more data processing systems may store the profile data. One or more relational or object-oriented databases, or flat files on one or more computers or networked storage devices, may store the profile data. In some embodiments, a centralized system stores the profile data; alternatively, a distributed/cloud system, network-based system, such as being implemented with a peer-to-peer network, or Internet, may store the profile data. The various aspects of the profiles data repositories 226 may be stored separately or consolidated into one repository.

In some embodiments, the controller 221 may include a matching engine 238 that may be an analysis engine. The matching engine 238 may be configured to perform any one or combination of features directed to matching or otherwise correlating information—and, in some embodiments, implementing machine learning—about components, action data, location data, temporal data, and/or the like. The captured data may be aggregated, consolidated, and transformed into refined profiles 226. In some embodiments, the monitoring engine 236 and/or the matching engine 238 may facilitate one or more learning/training modes. Some embodiments may perform image analysis of image data captured with cameras on one or more components of the fastener removal system 100 and/or other associated devices to determine one or more image baselines for railway components. Captured railway image data may be correlated to reference images using any suitable railway component traits for correlation.

For example, in some embodiments, the matching engine 238 may determine component characteristics based at least in part on adjustment input 202 received and processed by the monitoring engine 236. The matching engine 238 may define attributes of a railway component sensed based at least in part on the particular characteristics. The matching engine 238 may link railway image data to railway component profiles with image data associated with railway components, to determine identities of railway components. The reference image data may be refined over time as an image baselines for particular railway components are developed with additional data captures. Such reference images may be used by the system to identify inconsistencies/nonconformities with respect to particularized patterns. When the system captures new images of a detected fasteners 116 in a tie plate 114, the system may analyze the image and perform comparative analyses of the detected fasteners 116 and/or tie plate 114 with respect to reference image data and/or other fastener and/or tie plate profile 257 information to determine consistencies and identify any inconsistencies. With such comparative analyses, the system may provide error checking and correction for instances where an operator misidentifies a fastener (e.g., identifying a fastener via the user interface in a position where there is no fastener detected, overlooks a fastener by not selecting the fastener via the user interface for extraction), and/or where the operator misidentifies as a template a fastener and tie plate configuration/pattern where the fasteners and/or fastener holes do not match the detected fasteners and/or fastener holes of the detected tie plate (e.g., when a previously selected pattern of fastener extraction does not match a detected set of one or more fasteners).

When such inconsistencies/nonconformities satisfy one or more thresholds, certain adjustment actions may be caused and/or recommended via the user interface. For example, when a detected fastener and/or hole placement in a detected tie plate deviates from a designated tie plate template by more than a first threshold (e.g., a sixteenth of inch or more), the system 201 may generate a user notification regarding the deviation, and may adjust the fastener extractor 104 by the deviated distance to accurately engage a fastener 116 to extract it from the deviated hole. However, when a detected fastener and/or hole placement in a detected tie plate 114 deviates from a designated tie plate pattern by more than a second threshold (e.g., an inch or more), the system 201 may generate a user notification regarding the deviation, and may or may not require operator confirmation before adjusting the fastener extractor 104 by the deviated distance to accurately engage a fastener 116 to extract it from the deviated hole. In such cases, a different fastener and/or tie plate profile 257 may be generated or selected before proceeding. As another example, when a detected fastener is obstructed (e.g., by a stone), the system 201 may generate a user notification regarding the obstruction, and may pause installation operations until operator intervention is received. Thus, disclosed embodiments may ensure consistent, accurate, and safe engagement of fasteners 116. As with all notifications, such notifications may include surfacing an image(s) of the detected aspects to the user interface. Moreover, such notifications and the corresponding thresholds that trigger the notifications may be operator-configurable to account for case-specific variances and tolerances.

According to disclosed embodiments, one or more adjustment sequences may be initiated with a push of a button. Advantageously, disclosed embodiments may eliminate the need for one or more operators. The machine-directed operational features of the system 100 may correspond to technical improvements resulting in increased efficiencies, decreased costs, and less risk for operator error.

In operation, after the workhead is positioned generally over a given railway tie 110 needing fastener removal, further refinement of positioning of the fastener extractors 104 to facilitate fastener removal operations may be directed by control system 201 based at least in part on the captured sensor data to perfectly align the working assembly before it begins each separate task and subtask, as appropriate. The automatic positioning refinement may or may not be initiated by an operator via one or more user-selectable options presented with the operator interface. Such captured sensor data may include previously recorded patterning data, but may also include real-time sensor data. The real-time sensor data may be used by the control system 201 to identify inconsistencies and nonconformities, such as obstructions, variances in railway components with respect to one another and stored characteristics, and/or the like. The real-time sensor data, which may include image data of the railway components and installations, may be surfaced to an operator via the user interface. The real-time image data may include real-time video that may be presented so that an operator may monitor installation operations.

The adjustment sequence may include automatic guidance to make positioning determinations of positions of the railway fastener extractors 104, and to automatically guide the railway fastener extractor 104 into target positions. Such automatic guidance may include lowering the railway fastener extractor 104 from a stowed position to a deployed position, and positioning the railway fastener extractors 104 in a particular fastener addressing position to address a railway fastener 116 to grip and extract the railway fastener 116 from a railway tie 110. In some embodiments, each step or a subset of the steps of the one or more adjustment sequences may be separately initiated by an operator via operator control of input devices.

FIGS. 8B, 8C, 8D, and 8E illustrate some graphical aspects of an exemplary portion of an operator interface 300, in accordance with disclosed embodiments of the present disclosure. As disclosed herein, the system controller 221 may generate a user interface 300 for an operator to view and control various aspects of the system 100 via user-selectable options of the user interface. The control system 201, having identified a particular tie plate 114 configuration corresponding to the detected tie plate 114 with the one or more sensors, may generate the operator interface 300 to illustrate the corresponding tie plate design. For example, the operator interface 300 may illustrate a geometrically accurate tie plate design 302 that may correspond to the detected tie plate 114. Similarly, the control system 201, having identified a railway fastener 116 configuration corresponding to the detected set of one or more fasteners 116 with the one or more sensors, may generate the operator interface 300 to illustrate the corresponding fastener images and positions. For example, the operator interface 300 may illustrate detected fasteners 116 on the geometrically accurate tie plate design 302 corresponding to the detected tie plate 114, as illustrated in FIGS. 22D and 22E.

The control system 201 may be loaded with common fastener, anchor, tie plate, and rail design specifications, which may be stored in the profiles 257. In some cases, design drawings may be loaded into the control system 201 to be used by the control system 201 to develop fastener, anchor, tie plate, and rail profiles 257 and graphical depictions, such as that illustrated with the fastener and tie plate design 302, which may be to scale in some embodiments. Additionally or alternatively, the control system 201 may detect fastener, anchor, tie plate, and rail tie plate characteristics with one or more sensors. For example, captured sensor data for a particular tie plate 114 may be used to create a tie plate profile. Likewise, captured sensor data for other railway components, such as a particular railway fastener 116, may be used to create another railway component profile, such as a fastener profile.

Captured images of the particular railway components may be used for the various railway component profiles 257. For example, captured images of the particular fastener 116 and tie plate 114 may be used for the fastener profile 257 and tie plate profile 257. The fastener and tie plate profiles 257 may include information that may be used as templates for fastener extraction operation. The fastener and tie plate profiles 257 may include fastener and tie plate characteristics, such as a fastener and tie plate identifiers (e.g., model numbers), physical dimension information, fastener hole position information, fastener hole size information, field side and gage side identifiers, shape, contour, and other geometrical modelling information, images, and/or the like. Disclosed embodiments may likewise include features for capturing images of other railway components, such as anchors 114(*a*), 114(*b*) and the rail 108 itself, and for using the images to develop profiles for those components.

In some embodiments, as the workhead is positioned over each tie plate 114, the control system 201 may analyze sensor data to identify characteristics of the particular tie plate 114, such as dimensions and hole placement. Having identified the tie plate characteristics, the control system 201 may search retained tie plate profiles 257 to compare the identified tie plate characteristics with defined attributes (e.g., dimension and hole configuration attributes in attribute fields) stored in the tie plate profiles to determine whether or not a matching tie plate profile 257 already exists in the system 201. With the matching and installation processes, the control system 201 may additionally account for the variances concomitant with direction of travel and on which rail 108 of the pair of rails 108 the workhead is used. With these variances, the orientations of tie plates 114 change, and positions of associated fastener holes change from the perspective of the workhead.

When there is a matching tie plate profile 257 stored by the control system 201, the control system 201 may utilize the matching tie plate profile 257 to perform machine-directed fastener extraction for the given tie plate 114, as well as subsequent matching tie plates 114. Upon identification of the matching tie plate profile 257, the control system 201 may cause a notification to presented via the user interface 300.

The notification of the match may include a graphical depiction of the matching tie plate, the matching dimensions, and/or the matching hole configuration. For example, the tie plate design 302 that may correspond to detected tie plate 114 and matching tie plate profile 257 may be presented. The notification may further include surfacing an image(s) of the detected tie plate 114 alongside or overlaid on the graphical depiction 302 of the matching tie plate. In the case of an overlay, one or both of the image(s) of the detected tie plate 114 and the graphical depiction 302 of the matching tie plate may be rescaled so that each have the same scale. The overlay of the image(s) of the detected tie plate 114 may be a composite of multiple detected images, as well as one or more supplemental images. For example, to represent both the gage side and the field side of a tie plate 114, multiple images may be assembled. Since the portion of the tie plate 114 that is covered by the rail 108 is not visible, the system 201 may omit that portion from the overlay or supplement that portion with a system-generated graphic.

Figure 8B:
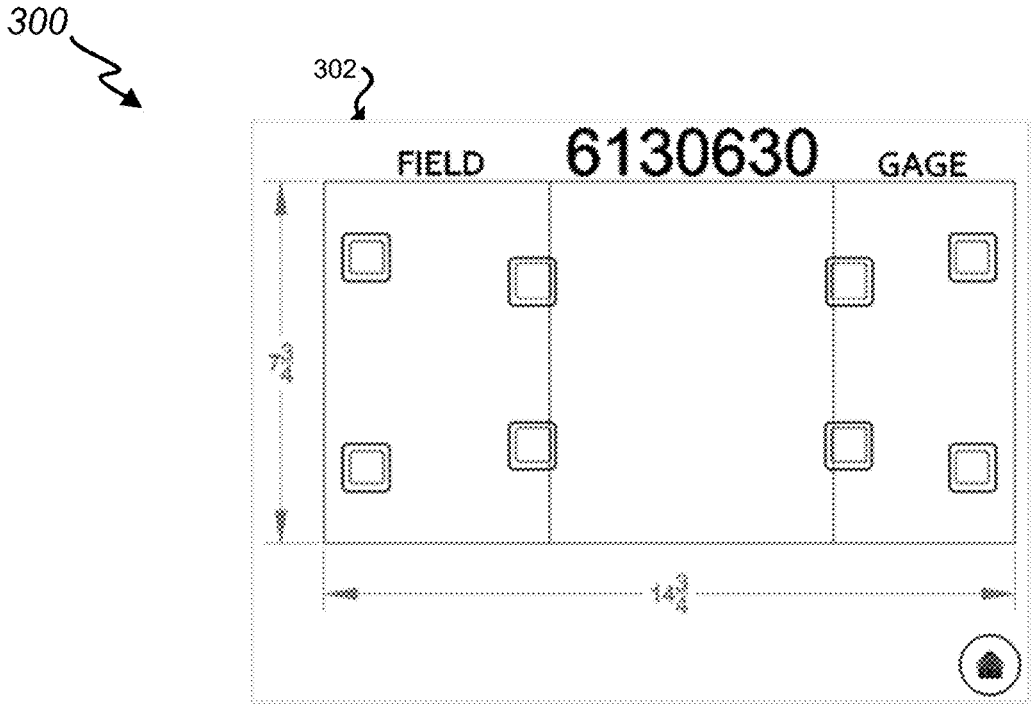
FIGS. 8B, 8C, 8D, and 8E illustrate some graphical aspects of an exemplary portion of an operator interface, in accordance with disclosed embodiments of the present disclosure.
Figure 8C:
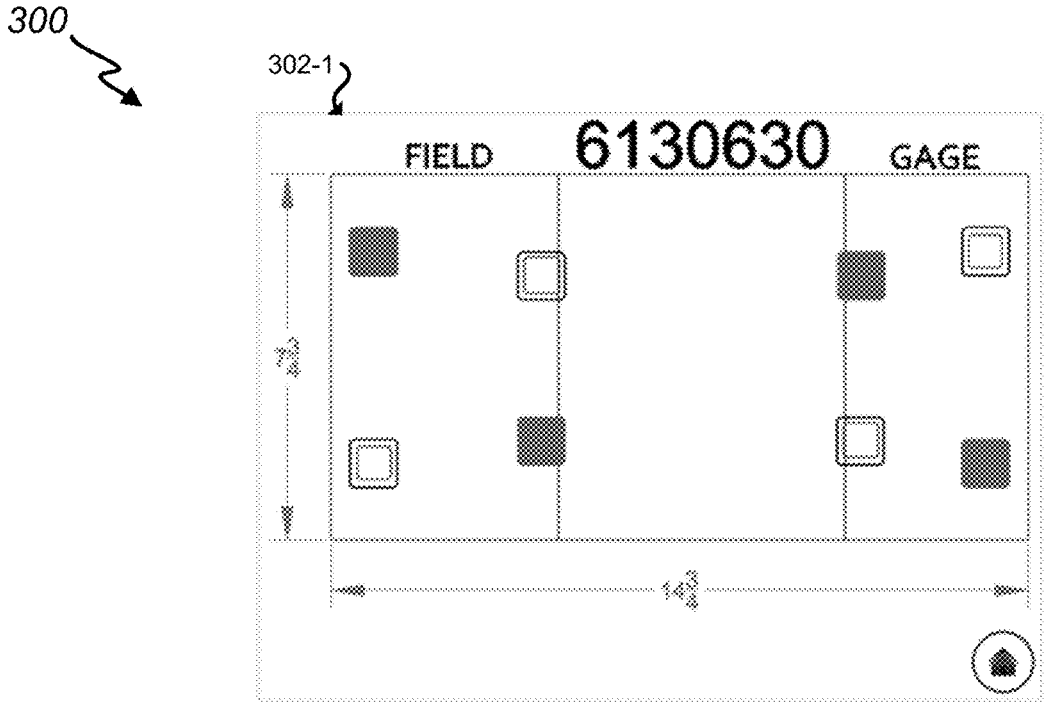

Further, the notification may prompt operator selection or confirmation of the fasteners 116 to be extracted from select holes of the tie plate 114. For example, FIG. 8B illustrates the tie plate design 302-1 with a subset of selected holes for fastener extraction. User-selectable options (e.g., via a touchscreen interface or another suitable means) may be provided to correspond to each hole of the depicted tie plate design 302-1. With the user-selectable options, the operator may designate from which holes have fasteners 116 that should be extracted. In some cases, the depicted tie plate design 302-1 may be pre-populated with the last received fastener selections for the particular tie plate design 302-1. In some cases, the depicted tie plate design 302-1 may be pre-populated with the last received fastener selections for the particular tie plate design 302-1 when detected fasteners 116 installed in the tie plate 114 match the last received fastener selections. However, when there is a mismatch, a notification identifying the mismatch and prompting user selection may be generated and presented via the user interface.

In some embodiments, in addition or in alternative to identifying characteristics of the particular tie plate 114, the control system 201 may analyze sensor data to identify characteristics of the detected set of one or more railway fasteners 116. Having identified the fastener characteristics, the control system 201 may search retained fastener profiles 257 to compare the identified tie plate characteristics with defined attributes (e.g., dimension attributes in attribute fields) stored in the tie plate profiles to determine whether or not a matching fastener profile 257 already exists in the system 201. When there is a matching fastener profile 257 stored by the control system 201, the control system 201 may utilize the matching fastener profile 257 to perform machine-directed fastener extraction for the set of one or more fasteners 116, as well as subsequent matching fasteners 116. Upon identification of the matching fastener profile 257, the control system 201 may cause a notification to presented via the user interface 300.

Figure 8D:
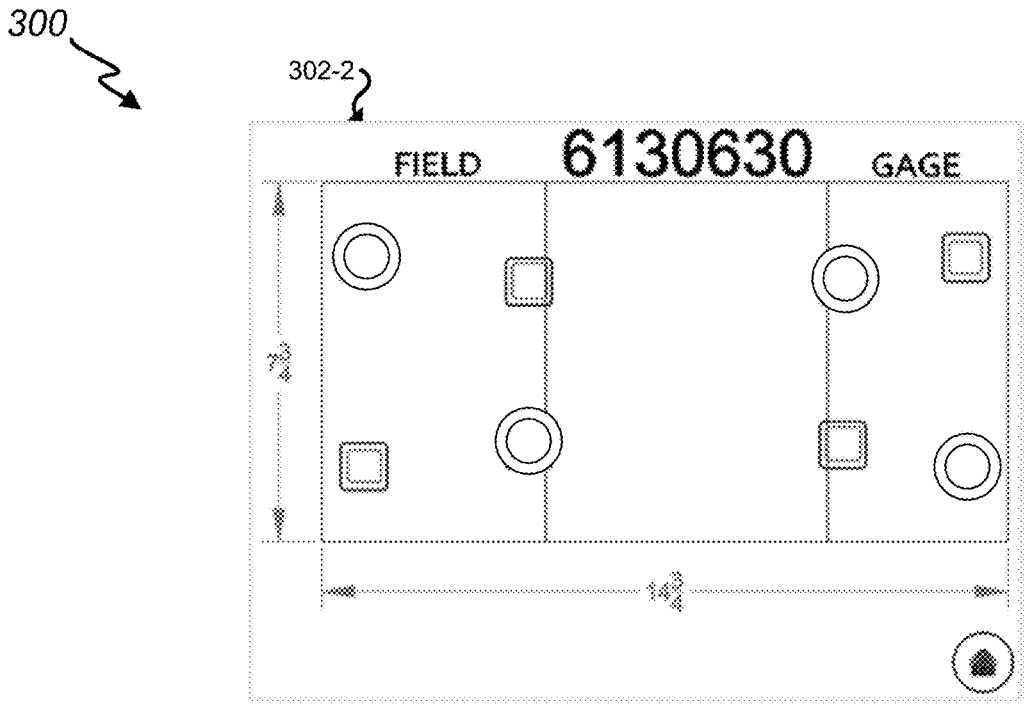

The notification of the match may include a graphical depiction of the matching fastener(s), which may include the matching dimensions. The notification may further include surfacing an image(s) of the detected set of one or more fasteners 116, which may be overlaid on the graphical depiction 302 of the matching tie plate, as illustrated by FIG. 8D. In alternatives, image(s) of the detected set of one or more fasteners 116 may be presented without images of the tie plate. In the case of an overlay, one or both of the image(s) of the detected set of one or more fasteners 116 and the graphical depiction 302 of the matching tie plate may be rescaled so that each have the same scale.

Figure 8E:
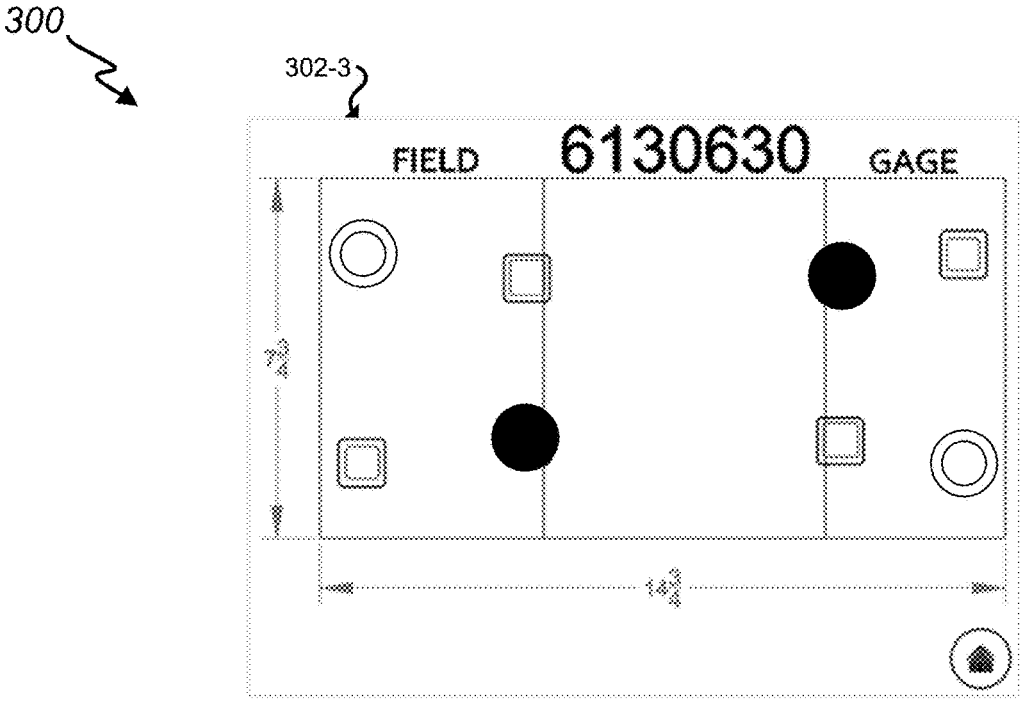

Further, the notification may prompt operator selection or confirmation of the fasteners 116 to be extracted from select holes of the tie plate 114. For example, FIG. 8E illustrates the tie plate design 302-1 with a subset of selected fasteners for fastener extraction. User-selectable options (e.g., via a touchscreen interface or another suitable means) may be provided to correspond to each fastener of the depicted set of one or more fasteners 116. With the user-selectable options, the operator may designate from which holes fasteners 116 should be extracted.

In some embodiments, upon detection of the set of one or more fasteners 116, a notification may prompt operator confirmation of the detected set of one or more fasteners 116 to proceed with the fastener extraction operations without further operation interaction. In one mode, the operator may indicate the sequence of fastener extraction, i.e., which fastener 116 should be extracted first, second, third, etc. In another mode, the operator need only indicate or confirm which fasteners 116 should be extracted. With that input, the control system 201 may determine the optimal sequence based at least in part on efficiency of movement of the fastener extractors 104. With the former mode, when the operator indicates the sequence, the control system 201 may determine the optimal sequence as in the latter mode and then compare the operator-indicated sequence to the optimal sequence. If the two sequences are not equivalent, the control system 201 may cause a notification to be presented to the operator, recommending the optimal sequence and prompting the operator to accept or reject the optimal sequence with selection of one or more user-selectable options presented with the operator interface 300.

In some embodiments, the control system 201 may cause a notification to be presented via the operator interface 300 upon detection of each tie plate 114 and/or set of one or more fasteners 116. Further, the control system 201 may prompt operator confirmation of the match to proceed with the fastener operations without further operation interaction with each tie plate 114 and/or set of one or more fasteners 116, so that the operator must provide a separate confirmation to proceed each time a tie plate 114 and/or set of one or more fasteners 116 is encountered. However, other embodiments may not require such confirmation, but may proceed with the fastener extraction operations with respect to a series of tie plates 114 and sets of one or more fasteners 116 without further operation interaction. Such operations may proceed until the control system 201 identifies one or more inconsistencies/nonconformities with respect to the particularized pattern, which may include a detected change to a different fastener configuration, tie plate configuration, an obstruction, an missing tie plate, a non-centered or otherwise ill-placed tie plate with respect to the tie, and/or the like. At that time, the control system 201 may cause a notification to presented via the operator interface 300 and may or may not require operator interaction in order to proceed further, depending on the extent of the detected inconsistencies/nonconformities.

When there is no matching tie plate and/or fastener profile 257 stored by the control system 201, the control system 201 may transition to a learning mode. The control system 201 may facilitate one or more learning modes. In one operational mode of the system 100, an operator may train the control system 201 to record a fastener extraction procedure for a given tie plate 114 and set of one or more fasteners 116. For example, the control system 201 provide a user-selectable option to record a sequence of fastener extraction operations in order to learn a new template for fastener extraction. An operator may select the record option to initiate system recording, then proceed to direct fastener extraction to completely extract the set of one or more fasteners 116 in a first tie plate 114, which may or may not correspond to extracting every fastener 116 in the tie plate 114. In some embodiments, this training may include the operator directly controlling each instance of fastener extraction for the given tie plate 114 and set of one or more fasteners 116. With the sensor feedback, the control system 201 may learn the pattern of fastener extraction for the particular tie plate 114 and set of one or more fasteners 116. Some embodiments may learn and infer positions of fasteners 116 in tie plates 114 using the detected positions of the cylinders, as detected by the associated position sensors. Additional disclosed embodiments may utilize other types of sensors, which may or may not in conjunction with position sensors, to learn and detect positions of fasteners 116. The control system 201 may store the learned pattern of fasteners 116, as well as the positioning and extraction operations of the railway fastener extractors 104, as part of a tie plate and/or fastener profile 257 for subsequent fastener extraction operations. The pattern may be stored by the control system 201 along with various other learned patterns for subsequent use. Such options for various patterns may be provided for operator selection via the graphical operator interface 300.

With the initial learning instance and subsequent learning instances with sensor data for corresponding tie plates 114 and/or set of one or more fasteners 116, the control system 201 may progressively learn and develop tie plate and/or fastener profiles 257. In such cases, the control system 201 may generate graphical depictions such as that illustrated with the tie plate and/or fastener configuration 302 based at least in part on the learned and developed tie plate and/or fastener profiles 257. Having learned a configuration, the system 100 may perform machine-directed fastener installation for subsequent tie plates 114 having configurations that match the fastener configuration of the learned configuration. By way of example, with subsequent tie plates 114 and sets of one or more fasteners 116 in a series, the pattern may be repeated such that the control system 201 may direct installation operations according to the learned pattern.

In some operational modes, one fastener 116 of the fastener pattern may be designated by the operator as the index fastener such that rest of the pattern is keyed off that index fastener. By default, the index fastener may be the first fastener position identified by the operator. In other instances, the operator may separately designate one fastener as an index hole. Having trained the control system 201 to proceed with the recorded extraction pattern based at least in part on the index fastener, the operator may select and confirm each index fastener each time a tie plate 114 and set of one or more fasteners 116 are encountered in order to initiate system-directed completion of the extraction pattern, keying off that index fastener selected by the operator. In some embodiments, the operator may extract a fastener 116 to designate it as the index fastener; in other embodiments, the operator may merely identify or position the claws of an extractor 104 over the index fastener. In either case, using the previously learned pattern for the particular fastener configuration, the control system 201 may then automatically complete fastener extraction for each tie plate 114 and set of one or more fasteners 116 without further operator input or interaction after initial direction to the index fastener. This and other system-controlled may free up the operator to perform other tasks.

Figure 9:
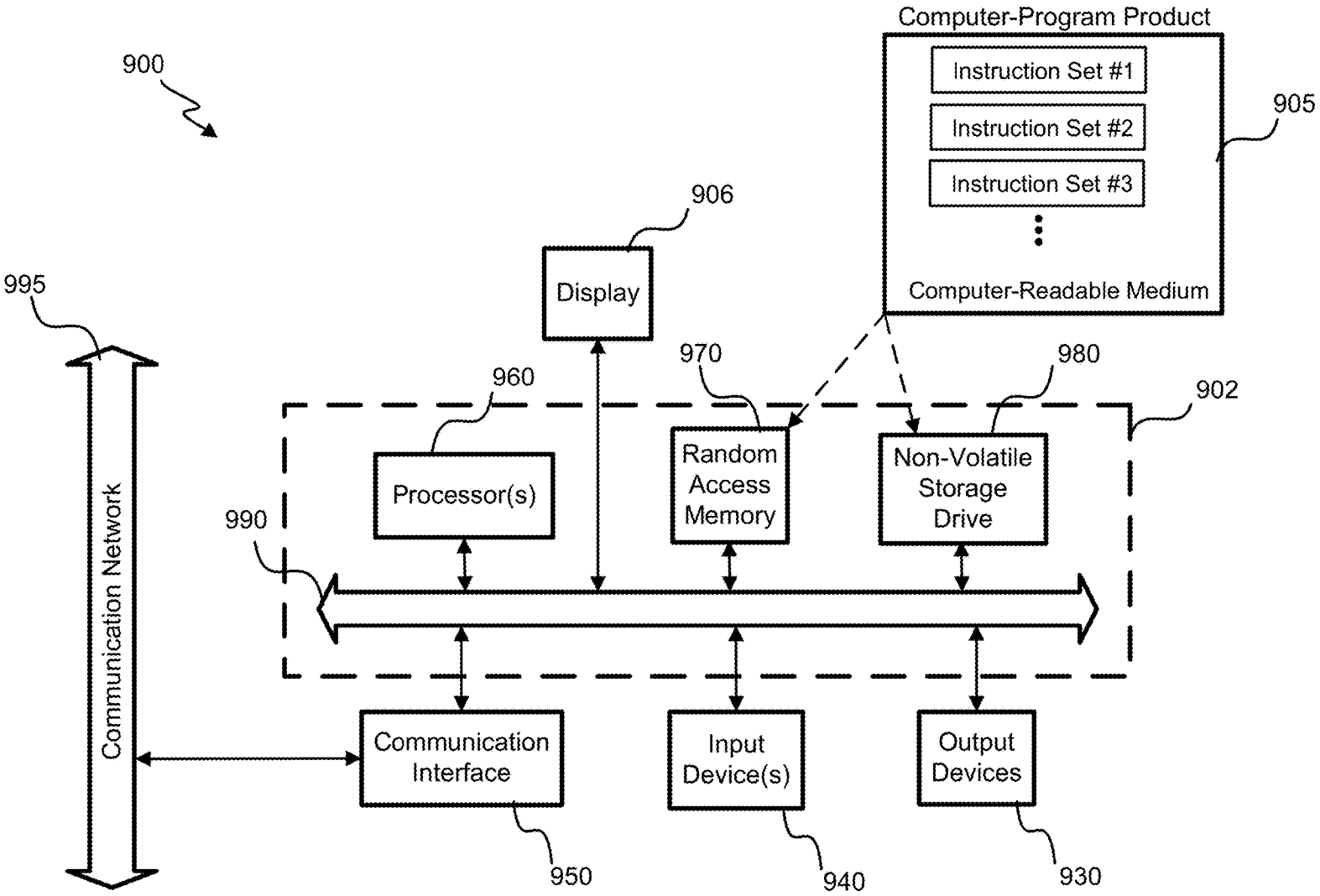
FIG. 9 is a diagram of an embodiment of a special-purpose computer system, in accordance with certain embodiments of the present disclosure.

With reference to FIG. 9, an embodiment of a special-purpose computer system 900 is shown. The above methods may be implemented by computer-program products that direct a computer system to perform the actions of the above-described methods and components. In some embodiments, the special-purpose computer system 900 may implement the subsystem 200. In some embodiments, the special-purpose computer system 900 may be included in a control system 201 that could, for example, be included in an operator station. Each such computer-program product may comprise sets of instructions (codes) embodied on a computer-readable medium that directs the processor of a computer system to perform corresponding actions. The instructions may be configured to run in sequential order, or in parallel (such as under different processing threads), or in a combination thereof. Merely by way of example, one or more procedures described with respect to the method(s) discussed herein might be implemented as code and/or instructions executable by a computer (and/or a processor within a computer); in an aspect, then, such code and/or instructions can be used to configure and/or adapt a general purpose computer (or other device) to perform one or more operations in accordance with the described methods, transforming the computer into the special-purpose computer system 900.

As discussed further herein, according to a set of embodiments, some or all of the procedures of such methods are performed by the computer system 900 in response to processor-execution of one or more sequences of one or more instructions (which might be incorporated into the operating system and/or other code, such as an application program) contained in the working memory. Such instructions may be read into the working memory from another computer-readable medium, such as one or more of the non-transitory storage device(s). Merely by way of example, execution of the sequences of instructions contained in the working memory might cause the processor(s) to perform one or more procedures of the methods described herein.

Special-purpose computer system 900 may include a computer 902, a display 906 coupled to computer 902, one or more additional user output devices 930 (optional) coupled to computer 902, one or more user input devices 940 (e.g., joystick, keyboard, mouse, track ball, touch screen, buttons, switches, control handles, and/or the like) coupled to computer 902, an optional communications interface 950 coupled to computer 902, a computer-program product 905 stored in a tangible computer-readable memory in computer 902. Computer-program product 905 directs system 900 to perform the above-described methods. Computer 902 may include one or more processors 960 that communicate with a number of peripheral devices via a bus subsystem 990. These peripheral devices may include user output device(s) 930, user input device(s) 940, communications interface 950, and a storage subsystem, such as random access memory (RAM) 970 and non-volatile storage drive 980 (e.g., disk drive, optical drive, solid state drive), which are forms of tangible computer-readable memory.

Computer-program product 905 may be stored in non-volatile storage drive 980 or another computer-readable medium accessible to computer 902 and loaded into memory 970. Each processor 960 may comprise a microprocessor, such as a microprocessor from Intel or Advanced Micro Devices, Inc.®, or the like. To support computer-program product 905, the computer 902 runs an operating system that handles the communications of product 905 with the above-noted components, as well as the communications between the above-noted components in support of the computer-program product 905. Exemplary operating systems include Windows® or the like from Microsoft® Corporation, Solaris® from Oracle®, LINUX, UNIX, and the like. The processors 960 may include one or more special-purpose processors such as digital signal processing chips, graphics acceleration processors, video decoders, image processors, and/or the like.

User input devices 940 include all possible types of devices and mechanisms to input information to computer system 902. These may include a keyboard, a keypad, a mouse, a scanner, buttons, control handles, switches, a digital drawing pad, a touch screen incorporated into the display, audio input devices such as voice recognition systems, microphones, and other types of input devices. In various embodiments, user input devices 940 are typically may be embodied as a computer mouse, a trackball, a track pad, a joystick, buttons, control handles, switches, wireless remote, a drawing tablet, a voice command system. User input devices 940 typically allow a user to select objects, icons, text and the like that appear on the display 906 via a command such as a click of a button or the like. User output devices 930 include all possible types of devices and mechanisms to output information from computer 902. These may include a display 906 (e.g., a monitor and/or a touchscreen), printers, non-visual displays such as audio output devices, etc. Some embodiments may not have a separate display 906, but may have displays integrated with input devices and/or output devices, such as mobile devices, touchscreen devices, etc.

Communications interface 950 provides an interface to other communication networks 995 and devices and may serve as an interface to receive data from and transmit data to other systems, WANs and/or the Internet 918. Embodiments of communications interface 950 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 950 may be coupled to a computer network, to a FireWirex bus, or the like. In other embodiments, communications interface 950 may be physically integrated on the motherboard of computer 902, and/or may be a software program, or the like. In further examples, the communications interface 950 may be part of a communications subsystem, which can include without limitation a modem, a network card (wireless or wired), an infrared communication device, a wireless communication device, and/or a chipset (such as a Bluetooth™ device, BLE, an 802.11 device, an 802.15.4 device, a WiFi device, a WiMax device, cellular communication device, etc.), and/or the like. The communications subsystem may permit data to be exchanged with a network (such as the network described below, to name one example), other computer systems, and/or any other devices described herein.

RAM 970 and non-volatile storage drive 980 are examples of tangible computer-readable media configured to store data such as computer-program product embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 970 and non-volatile storage drive 980 may be configured to store the basic programming and data constructs that provide the functionality of various embodiments of the present invention, as described above. The above are examples of one or more non-transitory storage devices that may be utilized by the system 900. Such storage devices may be configured to implement any appropriate data stores, including without limitation, various file systems, database structures, and/or the like.

Software instruction sets that provide the functionality of the present invention may be stored in RAM 970 and non-volatile storage drive 980. These instruction sets or code may be executed by the processor(s) 960. RAM 970 and non-volatile storage drive 980 may also provide a repository to store data and data structures used in accordance with the present invention. RAM 970 and non-volatile storage drive 980 may include a number of memories including a main random access memory (RAM) to store of instructions and data during program execution and a read-only memory (ROM) in which fixed instructions are stored. RAM 970 and non-volatile storage drive 980 may include a file storage subsystem providing persistent (non-volatile) storage of program and/or data files. RAM 970 and non-volatile storage drive 980 may also include removable storage systems, such as removable flash memory.

Bus subsystem 990 provides a mechanism to allow the various components and subsystems of computer 902 communicate with each other as intended. Although bus subsystem 990 is shown schematically as a single bus, alternative embodiments of the bus subsystem may utilize multiple busses or communication paths within the computer 902.

The above methods may be implemented by computer-program products that direct a computer system to control the actions of the above-described methods and components. Each such computer-program product may comprise sets of instructions (codes) embodied on a computer-readable medium that directs the processor of a computer system to cause corresponding actions. The instructions may be configured to run in sequential order, or in parallel (such as under different processing threads), or in a combination thereof. Special-purpose computer systems disclosed herein include a computer-program product(s) stored in tangible computer-readable memory that directs the systems to perform the above-described methods. The systems include one or more processors that communicate with a number of peripheral devices via a bus subsystem. These peripheral devices may include user output device(s), user input device(s), communications interface(s), and a storage subsystem, such as random access memory (RAM) and non-volatile storage drive (e.g., disk drive, optical drive, solid state drive), which are forms of tangible computer-readable memory.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, hydraulic, pneumatic, and/or electric control connections, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs) or programmable logic controllers (PLCs), field programmable gate arrays (FPGAs), image processors, controllers, micro-controllers, microprocessors, other electronic units designed to perform the functions described above, and/or a combination thereof.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the terms "storage medium," "storage media," "computer-readable medium," "computer-readable media," "processor-readable medium," "processor-readable media," and variations of the term may represent one or more devices for storing data, including read only memory (ROM), random access memory (RAM), magnetic RAM, core memory, magnetic disk storage mediums, optical storage mediums, flash memory devices and/or other machine readable mediums for storing information. The terms, computer-readable media, processor-readable media, and variations of the term, include, but are not limited to portable or fixed storage devices, optical storage devices, wireless channels and various other mediums capable of storing, containing or carrying instruction(s) and/or data.

Certain elements of the system 100 may be in direct contact with each other and experience relative motion between their contacting (immediately adjacent) faces. In these instances, it may be sufficient to allow steel-on-steel contact and not experience overly destructive wear characteristics over time with normal use, depending on the quality of the base material of each component. Alternatively, in certain instances where relative motion occurs between faces of two or more components, it may be necessary to incorporate additional media between the components in order to absorb any wear from normal use into the replaceable wear component rather than the steel components. For example, a wear pad mounted between the faces of two sliding components to aid in reducing the friction between the two components as they move past one another and to minimize the amount of actual physical wear on the primary components. The wear pad would be the replaceable component meant to be discarded when physical wear reaches a certain limit.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

While the principles of the disclosure have been described above in connection with specific apparatuses and methods, it is to be clearly understood that this description is made only by way of example and not as limitation on the scope of the disclosure. Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered. Furthermore, while the figures depicting mechanical parts of the embodiments are drawn to scale, it is to be clearly understood as only by way of example and not as limiting the scope of the disclosure.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed:

1. A railway fastener removal system, comprising:

a railway fastener extractor couplable with a frame assembly and a cylinder and slide assembly of a railway workhead so that the railway fastener extractor is suspended from the cylinder and slide assembly;

the railway fastener extractor comprising:

a first actuator;

a second actuator coaxially coupled to the first actuator so that the first actuator and the second actuator share a longitudinal axis;

a pair of opposing claws, each opposing claw of the pair of opposing claws comprising a gripping surface; and a linkage system coupling the pair of opposing claws with the second actuator, the linkage system comprising linkages arranged about the longitudinal axis;

the first actuator operable to extend the pair of opposing claws toward a railway fastener when the railway fastener is in an installed position with respect to a railway tie plate and a railway tie alongside a rail so that the railway fastener extends through the railway tie plate and into the railway tie;

the second actuator operable to selectively apply a force to the linkage system, the force directed along the longitudinal axis;

the linkage system adapted to bifurcate the force and apply corresponding forces to move the linkages and move the pair of opposing claws so that the gripping surfaces close toward each other or open away from each other;

the railway fastener extractor operable to:

selectively grip the railway fastener with the gripping surfaces of the pair of opposing claws when the railway fastener is in the installed position by one operation of the second actuator;

extract the railway fastener from the railway tie plate and the railway tie by operation of the first actuator; and release the railway fastener after the railway fastener is extracted by a subsequent operation of the second actuator.

2. The railway fastener removal system of claim 1, further comprising the frame assembly and the cylinder and slide assembly of the railway workhead coupled to the railway fastener extractor, the cylinder and slide assembly comprising one or more additional actuators adapted to cause movement of the railway fastener extractor with respect to the frame assembly along multiple planes.

3. The railway fastener removal system of claim 2, further comprising a pair of railway fastener extractors in an opposing arrangement to selectively engage a first plurality of railway fasteners installed on a gage side of the rail and a second plurality of railway fasteners installed on a field side of the rail, wherein the railway fastener extractor is one of the pair of railway fastener extractors.

4. The railway fastener removal system of claim 3, wherein each railway fastener extractor of the pair of railway fastener extractors is configured to operate independently of the other of the pair of railway fastener extractors.

5. The railway fastener removal system of claim 4, wherein the railway fastener corresponds to a lag screw.

6. The railway fastener removal system of claim 5, wherein the lag screw comprises a head, and the railway fastener extractor is configured to grip the head of the lag screw.

7. The railway fastener removal system of claim 6, wherein the head of the lag screw is disposed at least partially in a recess of the railway tie plate when the lag screw is in the installed position.

8. A method of railway fastener removal, the method comprising:

causing aligning of a railway fastener extractor with a railway fastener when the railway fastener is in an installed position with respect to a railway tie plate and a railway tie alongside a rail so that the railway fastener extends through the railway tie plate and into the railway tie, the railway fastener extractor coupled with a frame assembly and a cylinder and slide assembly of a railway workhead so that the railway fastener extractor is suspended from the cylinder and slide assembly;

operating a first actuator of the railway fastener extractor to extend a pair of opposing claws of the railway fastener extractor toward a railway fastener when the railway fastener is in the installed position, where each opposing claw of the pair of opposing claws comprises a gripping surface;

operating a second actuator of the railway fastener extractor to selectively apply a force to a linkage system of the railway fastener extractor and to grip the railway fastener with the gripping surfaces of the pair of opposing claws when the railway fastener is in the installed position, the force directed along a longitudinal axis, where:

the second actuator is coaxially coupled to the first actuator so that the first actuator and the second actuator share the longitudinal axis; and the linkage system couples the pair of opposing claws with the second actuator, the linkage system comprising linkages arranged about the longitudinal axis, and the linkage system is adapted to bifurcate the force and apply corresponding forces to move the linkages and move the pair of opposing claws so that the gripping surfaces close toward each other or open away from each other;

operating the first actuator to extract the railway fastener from the railway tie plate and the railway tie; and operating the second actuator to release the railway fastener after the railway fastener is extracted.

9. The method of railway fastener removal of claim 8, wherein the causing aligning of a railway fastener extractor comprises operating one or more additional actuators of the cylinder and slide assembly to cause movement of the railway fastener extractor with respect to the frame assembly along multiple planes.

10. The method of railway fastener removal of claim 9, further comprising operating a pair of railway fastener extractors arranged in an opposing arrangement to selectively engage a first plurality of railway fasteners installed on a gage side of the rail and a second plurality of railway fasteners installed on a field side of the rail, wherein the railway fastener extractor is one of the pair of railway fastener extractors.

11. The method of railway fastener removal of claim 10, wherein the operating the pair of railway fastener extractors comprises operating each railway fastener extractor of the pair of railway fastener extractors independently of the other of the pair of railway fastener extractors.

12. The method of railway fastener removal of claim 11, wherein at least one railway fastener of the first plurality of railway fasteners and the second plurality of railway fasteners corresponds to a lag screw.

13. The method of railway fastener removal of claim 12, wherein the lag screw comprises a head, and the gripping of the lag screw comprises gripping the head of the lag screw.

14. The method of railway fastener removal of claim 13, wherein the head of the lag screw is disposed at least partially in a recess of the railway tie plate when the lag screw is in the installed position.

15. One or more non-transitory, machine-readable media having machine-readable instructions thereon which, when executed by one or more processing devices, causes the one or more processing devices to instruct a railway workhead to:

cause aligning of a railway fastener extractor with a railway fastener when the railway fastener is in an installed position with respect to a railway tie plate and a railway tie alongside a rail so that the railway fastener extends through the railway tie plate and into the railway tie, the railway fastener extractor coupled with a frame assembly and a cylinder and slide assembly of the railway workhead so that the railway fastener extractor is suspended from the cylinder and slide assembly;

cause operation of a first actuator of the railway fastener extractor to extend a pair of opposing claws of the railway fastener extractor toward a railway fastener when the railway fastener is in the installed position, where each opposing claw of the pair of opposing claws comprises a gripping surface;

cause operation of a second actuator of the railway fastener extractor to selectively apply a force to a linkage system of the railway fastener extractor and to grip the railway fastener with the gripping surfaces of the pair of opposing claws when the railway fastener is in the installed position, the force directed along a longitudinal axis, where:

the second actuator is coaxially coupled to the first actuator so that the first actuator and the second actuator share the longitudinal axis; and the linkage system couples the pair of opposing claws with the second actuator, the linkage system comprising linkages arranged about the longitudinal axis, and the linkage system adapted to bifurcate the force and apply corresponding forces to move the linkages and move the pair of opposing claws so that the gripping surfaces close toward each other or open away from each other;

cause operation of the first actuator to extract the railway fastener from the railway tie plate and the railway tie; and cause operation of the second actuator to release the railway fastener after the railway fastener is extracted.

16. The one or more non-transitory, machine-readable media of claim 15, wherein the causing aligning of a railway fastener extractor comprises operating one or more additional actuators of the cylinder and slide assembly to cause movement of the railway fastener extractor with respect to the frame assembly along multiple planes.

17. The one or more non-transitory, machine-readable media of claim 16, the one or more processing devices to further instruct the railway workhead to operate a pair of railway fastener extractors arranged in an opposing arrangement to selectively engage a first plurality of railway fasteners installed on a gage side of the rail and a second plurality of railway fasteners installed on a field side of the rail, wherein the railway fastener extractor is one of the pair of railway fastener extractors.

18. The one or more non-transitory, machine-readable media of claim 17, wherein the operating a pair of railway fastener extractors comprises operating each railway fastener extractor of the pair of railway fastener extractors independently of the other of the pair of railway fastener extractors.

19. The one or more non-transitory, machine-readable media of claim 18, wherein at least one railway fastener of the first plurality of railway fasteners and the second plurality of railway fasteners corresponds to a lag screw.

20. The one or more non-transitory, machine-readable media of claim 19, wherein the lag screw comprises a head, and the gripping of the lag screw comprises gripping the head of the lag screw.

* * * * *